US010080088B1

(12) United States Patent
Yang et al.

(10) Patent No.: US 10,080,088 B1
(45) Date of Patent: Sep. 18, 2018

(54) SOUND ZONE REPRODUCTION SYSTEM

(71) Applicant: Amazon Technologies, Inc., Seattle, WA (US)

(72) Inventors: Jun Yang, San Jose, CA (US); Haoliang Dong, Cupertino, CA (US); Yingbin Liu, Irvine, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 15/348,389

(22) Filed: Nov. 10, 2016

(51) Int. Cl.
*H04R 27/00* (2006.01)
*H04R 3/04* (2006.01)

(52) U.S. Cl.
CPC ..... *H04R 27/00* (2013.01); *H04R 3/04* (2013.01); *H04R 2203/12* (2013.01); *H04R 2227/005* (2013.01); *H04R 2430/01* (2013.01)

(58) Field of Classification Search
CPC ..... H04R 27/00; H04R 3/04; H04R 2203/12; H04R 2227/005; H04R 2430/01
USPC ..... 381/80
See application file for complete search history.

(56) References Cited

U.S. PATENT DOCUMENTS

2004/0234094 A1* 11/2004 Saunders ..... A61F 11/08 381/380
2014/0098966 A1* 4/2014 Corteel ..... H04S 7/301 381/59
2015/0016643 A1* 1/2015 Steffens ..... H04S 7/30 381/307

* cited by examiner

*Primary Examiner* — Quynh Nguyen
(74) *Attorney, Agent, or Firm* — Pierce Atwood LLP

(57) ABSTRACT

A system capable of directing audio output to a portion of a shared acoustic environment. For example, the system may divide the environment into two or more sound zones and may generate audio output directed to one or more sound zones. The system may distinguish between target sound zones and quiet sound zones and may determine a set of global filter coefficients with which to direct the audio output. The system may generate a first set of filter coefficients that increase audio volume in the target sound zones and a second set of filter coefficients that increase a ratio of audio volume between the target sound zones and the quiet sound zones. The system may generate the set of global filter coefficients using a combination of the first set and the second set. The system may also direct audio from multiple audio sources in different directions.

20 Claims, 10 Drawing Sheets

FIG. 2

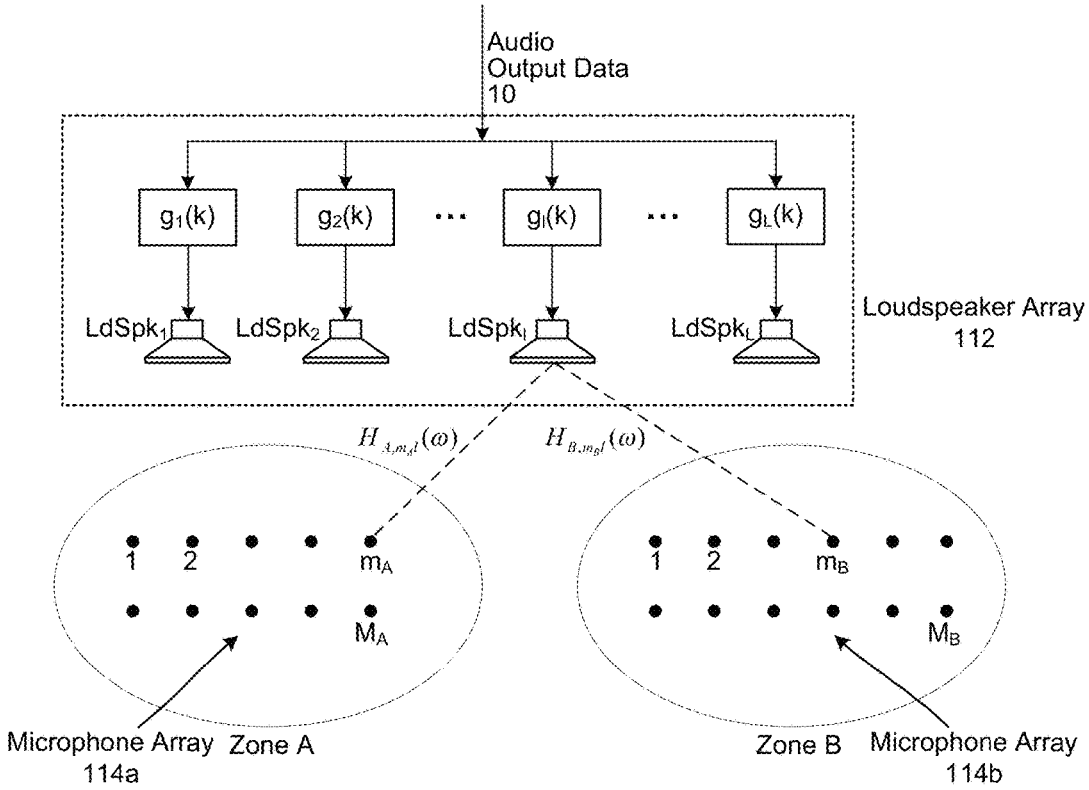

Transfer Function Matrix $$H_A(\omega) = \begin{pmatrix} H_{A,11}(\omega) & \dots & H_{A,1L}(\omega) \\ \dots & \dots & \dots \\ H_{A,M_A 1}(\omega) & \dots & H_{A,M_A L}(\omega) \end{pmatrix}$$

$$H_B(\omega) = \begin{pmatrix} H_{B,11}(\omega) & \dots & H_{B,1L}(\omega) \\ \dots & \dots & \dots \\ H_{B,M_B 1}(\omega) & \dots & H_{B,M_B L}(\omega) \end{pmatrix}$$

Sound Pressure
(at individual microphone)

$$p_{A,m_A}(\omega) = \sum_{l=1}^{L} H_{A,m_A l}(\omega) q_l(\omega), \qquad m_A = 1,2,\dots,M_A$$

$$p_{B,m_B}(\omega) = \sum_{l=1}^{L} H_{B,m_B l}(\omega) q_l(\omega), \qquad m_B = 1,2,\dots,M_B$$

Sound Pressure Vector
(for entire Zone)

$$p_A(\omega) = H_A(\omega) q(\omega) = [p_{A,1}(\omega), p_{A,2}(\omega), \dots, p_{A,M_A}(\omega)]$$

$$p_B(\omega) = H_B(\omega) q(\omega) = [p_{B,1}(\omega), p_{B,2}(\omega), \dots, p_{B,M_B}(\omega)]$$

SOUND ZONE REPRODUCTION SYSTEM

BACKGROUND

With the advancement of technology, the use and popularity of electronic devices has increased considerably. Electronic devices may generate audio in one or more sound zones. Disclosed herein are technical solutions to improve sound zone reproduction.

BRIEF DESCRIPTION OF DRAWINGS

For a more complete understanding of the present disclosure, reference is now made to the following description taken in conjunction with the accompanying drawings.

FIG. 2 illustrates an example of determining sound pressure values for individual sound zones.

DETAILED DESCRIPTION

Electronic devices may generate omnidirectional audio output. However, in a room with several devices, people sharing the room may desire to hear audio output relating to their own device without interference from the other devices. Although headphones can create isolated listening conditions, headphones isolate the listeners from the surrounding environment, hinder communications between the listeners and result in uncomfortable listening experience due to fatigue. A device may use a loudspeaker array to generate audio output that is focused in a target region, but increasing a volume level of the audio output in the target region may increase a volume level of the audio output in other regions, interfering with audio output from the other devices.

To improve a sound reproduction system, devices, systems and methods are disclosed that focus audio output in the target region while minimizing the volume levels of the audio output in surrounding regions. For example, a loudspeaker array may create different listening zones in a shared acoustic environment so that the audio output is directed to the target region and away from a quiet region. To focus the audio output, the system may determine one set of filter coefficients that increase a first audio volume level in the target region and a second set of filter coefficients that decrease a second audio volume level in the quiet region by increasing a ratio between the first audio volume level and the second audio volume level. The second set of filter coefficients may also include a power constraint to further decrease the second audio volume. The system may generate global filter coefficients by summing the weighted first filter coefficients and the second filter coefficients and may generate filters for the loudspeaker array using the global filter coefficients. In some examples, the system may generate audio output from multiple audio sources, such that a first audio output is directed to a first target region and a second audio output is directed to a second target region. In addition to the first target region and the second target region, the system may generate quiet region(s) that do not receive the first audio output or the second audio output.

Figure 1:
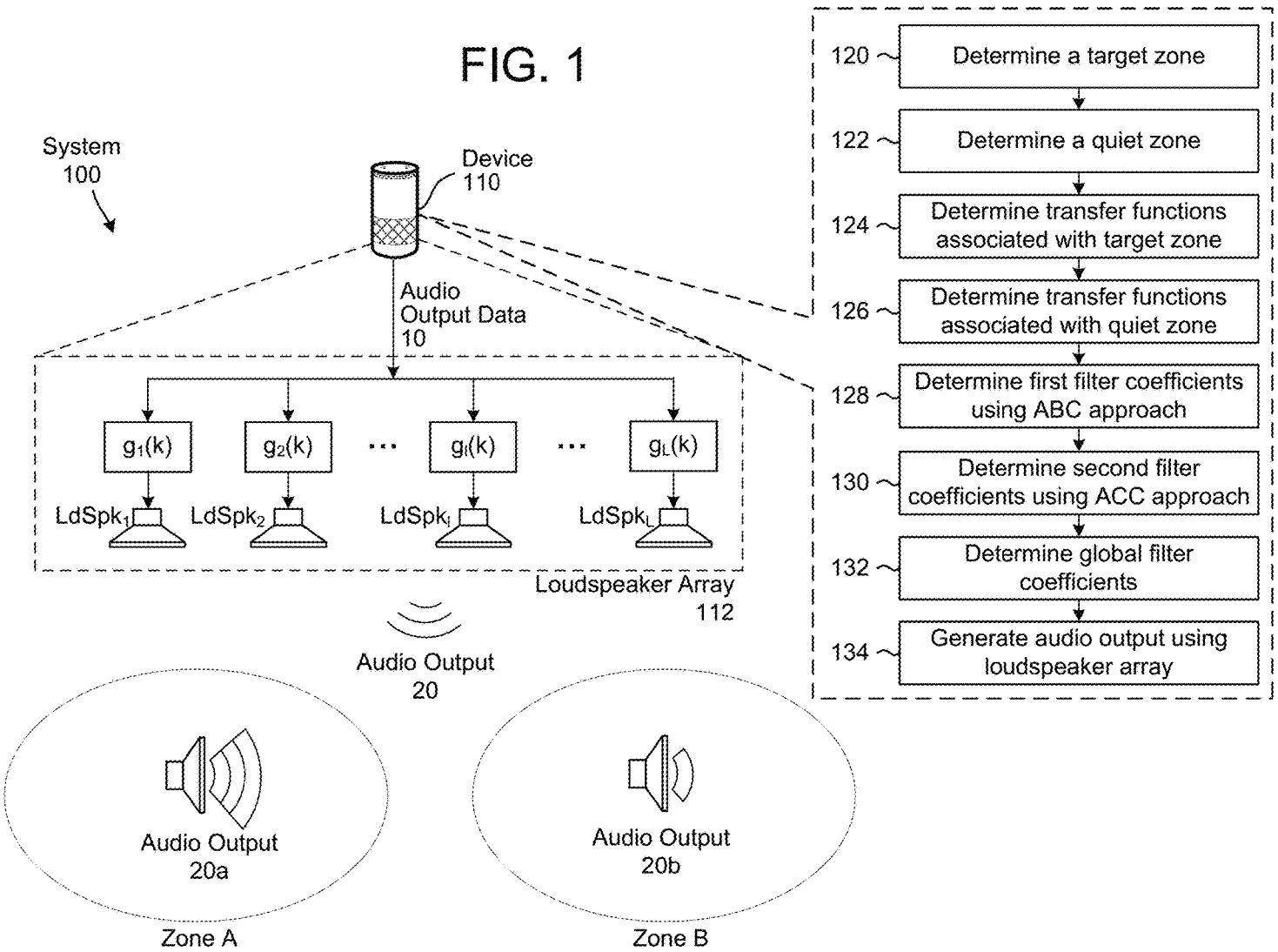
FIG. 1 illustrates a system according to embodiments of the present disclosure.

FIG. 1 illustrates a high-level conceptual block diagram of a system 100 configured to generate audio output in one or more sound zones. Although FIG. 1, and other figures/discussions illustrate the operation of the system in a particular order, the steps described may be performed in a different order (as well as certain steps removed or added) without departing from the intent of the disclosure.

As illustrated in FIG. 1, the system 100 may include a device 110 and/or a loudspeaker array 112. While FIG. 1 illustrates the device 110 as a speech-enabled device without a display, the disclosure is not limited thereto. Instead, the device 110 may be a television, a computer, a mobile device and/or any other electronic device capable of generating filters g(k). In some examples, the loudspeaker array 112 may be integrated in the device 110. For example, the device 110 may be an electronic device that includes the loudspeaker array 112 in place of traditional stereo speakers. Additionally or alternatively, in some examples the device 110 may be integrated in the loudspeaker array 112. For example, the loudspeaker array 112 may be a sound bar or other speaker system that includes internal circuitry (e.g., the device 110) configured to generate the audio output data 10 and/or determine the filters g(k). However, the disclosure is not limited thereto and the device 110 may be separate from the loudspeaker array 112 and may be configured to generate the audio output data 10 and/or to determine the filters g(k) and send the audio output data 10 and/or the filters g(k) to the loudspeaker array 112 without departing from the disclosure.

The loudspeaker array 112 may include a plurality of loudspeakers LdSpk (e.g., $LdSpk_1$, $LdSpk_2$, . . . , $LdSpk_L$). Each loudspeaker may be associated with a filter $g_l(k)$ (e.g., $g_1(k)$, $g_2(k)$, . . . , $g_L(k)$), such as an optimized FIR filter with a tap-length N. Collectively, the loudspeakers LdSpk may be configured to generate audio output 20 using the audio output data 10 and the filters g(k).

The system 100 may design the filters g(k) to focus the audio output 20 in Zone A and away from Zone B. For example, the system 100 may generate an Augmented Sound Zone (ASZ) in Zone A and a Quiet Sound Zone (QSZ) in Zone B. The Augmented Sound Zone may be associated with first audio output 20*a* having a first volume level (e.g., high volume level), whereas the Quiet Sound Zone may be associated with second audio output 20*b* having a second volume level (e.g., low volume level). Thus, the system 100 may selectively focus the audio output 20 so that a first listener present in Zone A may listen to the first audio output 20*a* (e.g., a volume of the audio output 20 is at the first volume level in proximity to the first listener) without bothering a second listener present in Zone B (e.g., a volume of the audio output 20 is at the second volume level in proximity to the second listener).

As used herein, an Augmented Sound Zone may refer to a target zone, a target region or the like that is associated with an audio source. For example, the device 110 may receive audio input from the audio source and may focus the audio output 20 in the ASZ so that a listener in the ASZ may hear the audio output 20 at high volume levels. Thus, the loudspeaker array 112 may create constructive interference for the ASZ. Similarly, as used herein a Quiet Sound Zone may refer to a quiet zone, a quiet region or the like that is not associated with an audio source. For example, the device 110 may focus the audio output 20 towards the ASZ so that a listener in the QSZ does not hear the audio output 20 and/or hears the audio output 20 at low volume levels. Thus, the loudspeaker array 112 may create destructive interference for the QSZ. Constructive interference occurs where two audio waveforms are "in-phase," such that a peak of a first waveform having a first amplitude is substantially aligned with a peak of a second waveform having a second amplitude, resulting in a combined waveform having a peak that has a third amplitude equal to the sum of the first amplitude and the second amplitude. Destructive interference occurs where the two audio waveforms are "out-of-phase," such that the peak of the first waveform having the first amplitude is substantially aligned with a trough of the second waveform having a fourth amplitude, resulting in a combined waveform having a fifth amplitude equal to the difference between the first amplitude and the fourth amplitude. Thus, constructive interference results in the third amplitude that is greater than the first amplitude, whereas destructive interference results in the fifth amplitude that is less than the first amplitude.

While FIG. 1 illustrates an example of dividing the shared acoustic space into two sound zones (e.g., Zone A and Zone B), the disclosure is not limited thereto and the system 100 may divide the shared acoustic space into three or more sound zones without departing from the disclosure. Thus, the system 100 may select multiple augmented sound zones and/or multiple quiet sound zones without departing from the disclosure. For example, the system 100 may select a first zone (e.g., Zone A) and a third zone (e.g., Zone C) as ASZs while selecting a second zone (e.g., Zone B) as a QSZ. Thus, a listener may hear audio in Zone A and in Zone C but not in Zone B. Alternatively, the system 100 may select the second zone (e.g., Zone B) as the ASZ while selecting the first zone (e.g., Zone A) and the third zone (e.g., Zone C) as the QSZ, so that a listener can hear audio in Zone B but not in Zone A and C. As can be understood by one of skill in the art, the system 100 may select any combination of ASZs and/or QSZs without departing from the disclosure.

In some examples, the system 100 may generate audio output at different volume levels in different sound zones using a single audio source. For example, the system 100 may generate first audio from a first audio source at a first volume level in a first zone (e.g., Zone A) and may generate second audio from the first audio source at a second volume level in a second zone (e.g., Zone B). Thus, while both the first zone and the second zone are receiving audio from the first audio source, the first volume level and the second volume level may be drastically different. To illustrate an example, a first user may listen to audio at a normal volume level while a second user may be hard of hearing and listen to audio at a high volume level. Instead of outputting the audio at the normal volume level, which the second user cannot hear properly, or at the high volume level, which is too loud for the first user, the system 100 may generate audio at the normal volume level in the first zone for the first user and at the high volume level in the second zone for the second user.

In some examples, the system 100 may generate audio output using two or more audio sources. For example, the system 100 may generate first audio from a first audio source in the shared acoustic space (e.g., Zone A and Zone B) while directing second audio from a second audio source to a target zone (e.g., Zone A). Thus, a listener may hear the first audio and the second audio in Zone A and only hear the first audio in Zone B. Additionally or alternatively, the system 100 may determine ASZs and QSZs for each of the audio sources. For example, the system 100 may direct the first audio source to Zone A and may direct the second audio source to Zone B. Thus, the system 100 may select Zone A as the first ASZ and Zone B as a first QSZ for the first audio source, while selecting Zone B as the second ASZ and Zone A as a second QSZ for a second audio source. Thus, a listener may hear the first audio source in Zone A and the second audio source in Zone B. The system 100 may generate the audio output using a single loudspeaker array 112 and/or using multiple loudspeaker arrays 112 without departing from the disclosure.

In some examples, the system 100 may generate audio output for two or more audio sources in the three or more sound zones. For each audio source, the system 100 may select one or more ASZs and the remaining sound zones may be selected as QSZs. For example, the system 100 may select a first ASZ (e.g., Zone A) for the first audio source while selecting QSZs (e.g., Zone B and Zone C) for the first audio source. Similarly, the system 100 may select a second ASZ (e.g., Zone C) for the second audio source while selecting QSZs (e.g., Zone A and Zone B) for the second audio source. Thus, a listener may hear first audio in Zone A, no audio in Zone B and second audio in Zone C.

FIG. 1 illustrates an example of dividing an area into two sound zones, an Augmented Sound Zone (e.g., Zone A) and a Quiet Sound Zone (e.g., Zone B). In order to create the desired sound zones, the audio output data 10 to the loudspeaker array 112 needs to be filtered. Therefore, as discussed above, each loudspeaker $LdSpk_1$ (e.g., $LdSpk_1$, $LdSpk_2$, . . . , $LdSpk_L$) in the loudspeaker array 112 may be associated with a filter $g_l(k)$ (e.g., $g_1(k)$, $g_2(k)$, $g_1(k)$), such as an optimized FIR filter with a tap-length N. The system 100 may design the filters g(k) to direct the audio output 20 toward the ASZ (e.g., Zone A) and away from the QSZ (e.g., Zone B) using a series of equations that relate the filters $g_l(k)$ to sound pressure values (e.g., volume levels) in Zone A and Zone B. For illustrative purposes the following description discloses a frequency domain approach to determining the filters $g_l(k)$, but the disclosure is not limited thereto and the system 100 may use a frequency domain approach and/or a time domain approach without departing from the disclosure.

The filters g(k) (e.g., $g_1(k)$, $g_2(k)$, . . . , $g_L(k)$) of all the loudspeakers in the loudspeaker array 112 (e.g., $LdSpk_1$, $LdSpk_2$, . . . , $LdSpk_L$) can be written as a vector of source weighting $q(\omega)=[q_1(\omega), q_2(\omega), \ldots, q_L(\omega)]^T$. The vector $q(\omega)$ defines the amplitudes and phases of the loudspeakers' weighting at a certain angular frequency $\omega$, which can produce the constructive and destructive interference necessary to generate the desired ASZ and QSZ. Thus, the system 100 may determine the filters g(k) from the vector $q(\omega)$ and vice versa.

To design the filters g(k), the system 100 may estimate sound pressure values (e.g., volume levels) in Zone A and Zone B. To determine a first overall sound pressure value $p_A(\omega)$ for Zone A and a second overall sound pressure value $p_B(\omega)$ for Zone B, the system 100 may determine individual sound pressure values for a plurality of microphones within Zone A and Zone B, respectively. For example, FIG. 2 illustrates a first microphone array 114*a* associated with Zone A and a second microphone array 114*b* associated with Zone B. The microphones in the microphone array 114 may be physical microphones located at a physical location in the sound zones or may be virtual microphones that estimate the signal received at the physical location without departing from the disclosure. A first number of microphones included in the first microphone array 114*a* may be different from a second number of microphones included in the second microphone array 114*b* without departing from the disclosure. Additionally or alternatively, a number of loudspeakers in the loudspeaker array 112 may be different from the first number of microphones and/or the second number of microphones without departing from the disclosure.

The system 100 may estimate sound pressure values for an individual microphone $m_A$ included in the first microphone array 114*a* (e.g., located in Zone A) using Equation 1:

$$P_{A,m_A}(\omega) = \sum_{l=1}^{L} H_{A,m_A l}(\omega) q_l(\omega),\ m_A = 1, 2, \ldots, M_A \tag{1}$$

where $p_{A,m_A}(\omega)$ is the sound pressure value at the microphone $m_A$, $\omega$ is an angular frequency, $H_{A,m_A l}(\omega)$ is a transfer function between the microphone $m_A$ and an individual loudspeaker $LdSpk_l$, and $q_l(\omega)$ is a complex frequency response of the loudspeaker $LdSpk_l$ filter (e.g., spatial weighting of the lth loudspeaker signal). Thus, to determine the sound pressure value $p_{A,m_A l}(\omega)$ at the microphone $m_A$, the system 100 may determine a transfer function $H_{A,m_A l}(\omega)$ (e.g., between the loudspeaker $LdSpk_l$ and the microphone $m_A$) and a filter $q_l(\omega)$ for each of the loudspeakers in the loudspeaker array 112 (e.g., $LdSpk_1$, $LdSpk_2 \ldots$, $LdSpk_L$).

Similarly, the system 100 may estimate sound pressure values for an individual microphone $m_B$ included in the second microphone array 114*b* (e.g., located in Zone B) using Equation 2:

$$P_{B,m_B}(\omega) = \sum_{l=1}^{L} H_{B,m_B l}(\omega) q_l(\omega),\ m_B = 1, 2, \ldots, M_B \tag{2}$$

where $p_{B,m_B}(\omega)$ is the sound pressure value at the microphone $m_B$, $\omega$ is an angular frequency, $H_{B,m_B l}(\omega)$ is a transfer function between the microphone $m_B$ and an individual loudspeaker $LdSpk_l$, and $q_l(\omega)$ is a complex frequency response of the loudspeaker $LdSpk_l$ filter (e.g., spatial weighting of the lth loudspeaker signal). Thus, to determine the sound pressure value $p_{B,m_B}(\omega)$ at the microphone $m_B$, the system 100 may determine a transfer function $H_{B,m_B l}(\omega)$ (e.g., between the loudspeaker $LdSpk_l$ and the microphone $m_B$) and a filter $q_l(\omega)$ for each of the loudspeakers in the loudspeaker array 112 (e.g., $LdSpk_1$, $LdSpk_2 \ldots$, $LdSpk_L$).

As illustrated in FIG. 2, a loudspeaker $LdSpk_l$ has a transfer function $H_{A,m_A l}(\omega)$ between the loudspeaker $LdSpk_l$ and a microphone $m_A$ in the first microphone array 114*a*, and a transfer function $H_{B,m_B l}(\omega)$ between the loudspeaker $LdSpk_l$ and a microphone $m_B$ in the second microphone array 114*b*. Thus, each loudspeaker $LdSpk_l$ has a transfer function $H(\omega)$ with each of the microphones in the first microphone array 114*a* (e.g., $m__{a1}$, $M__{a2}$, . . . , $M_A$) and each of the microphones in the second microphone array 114*b* (e.g., $M__{b1}$, $M__{b2}$, . . . , $M_B$), which can be illustrated using the following transfer function matrixes:

$$H_A(\omega) = \begin{pmatrix} H_{A,11}(\omega) & \ldots & H_{A,1L}(\omega) \\ \ldots & \ldots & \ldots \\ H_{A,M_A 1}(\omega) & \ldots & H_{A,M_A L}(\omega) \end{pmatrix} \tag{3}$$

$$H_B(\omega) = \begin{pmatrix} H_{B,11}(\omega) & \ldots & H_{B,1L}(\omega) \\ \ldots & \ldots & \ldots \\ H_{B,M_B 1}(\omega) & \ldots & H_{B,M_B L}(\omega) \end{pmatrix} \tag{4}$$

where $H_A(\omega)$ is a first transfer function matrix for Zone A having dimensions of $M_A \times L$ and $H_B(\omega)$ is a second transfer function matrix for Zone B having dimensions of $M_B \times L$.

As illustrated in Equation 3, each row of the first transfer function matrix $H_A(\omega)$ includes transfer functions between a single microphone in the first microphone array 114*a* and each of the loudspeakers in the loudspeaker array 112. For example, the first column in the first row is a transfer function between a first microphone $m_1$ and a first loudspeaker $LdSpk_1$, while the final column in the first row is a transfer function between the first microphone $m_1$ and a final loudspeaker $LdSpk_L$. Similarly, the first column in the final row is a transfer function between a final microphone $M_A$ and the first loudspeaker $LdSpk_1$, while the final column in the final row is a transfer function between the final microphone $M_A$ and the final loudspeaker $LdSpk_L$.

Thus, each column of the first transfer function matrix $H_A(\omega)$ includes transfer functions between a single loudspeaker in the loudspeaker array 112 and each of the microphones in the microphone array 114*a*. For example, the first row in the first column is a transfer function between the first loudspeaker $LdSpk_1$ and the first microphone $m_1$, while the final row in the first column is a transfer function between the first loudspeaker $LdSpk_1$ and the final microphone $M_A$. Similarly, the first row in the final column is a transfer function between the final loudspeaker $LdSpk_L$ and the first microphone $m_1$, while the final row in the final column is a transfer function between the final loudspeaker $LdSpk_L$ and the final microphone $M_A$.

As illustrated in Equation 4, each row of the second transfer function matrix $H_B(\omega)$ includes transfer functions between a single microphone in the second microphone array 114*b* and each of the loudspeakers in the loudspeaker array 112, and each column of the second transfer function matrix $H_B(\omega)$ includes transfer functions between a single loudspeaker in the loudspeaker array 112 and each of the microphones in the second microphone array 114*b*, similar to the description above for Equation 3.

The system 100 may determine the transfer functions $H(\omega)$ based on a database of impulse responses. For example, the system 100 may use a microphone array or other inputs to determine an impulse response, compare the impulse response to a database of impulse responses and generate an environment impulse response for the shared acoustic environment. Additionally or alternatively, the system 100 may use an interpolation approach to determine an actual impulse response of the shared acoustic environment using techniques known to one of skill in the art. A representative example is as follows. Assuming that (1) we know the room impulse responses between loudspeaker j and two known microphones $m_1$ and $m_2$ closest to the actual user location i, say, $\{h_{m1,j}(0), h_{m/1,j}(1), \ldots, h_{m1,j}(K)\}$ and $\{h_{m2,j}(0), h_{m2,j}(1), \ldots, h_{m2,j}(K)\}$ are known (K is the length of the impulse response, for example, K is 4800 for 100 ms of 48 kHz sampling rate), and (2). the impulse responses are smoothly varying in space at a given time between the two known microphones $m_1$ and $m_2$, then we can use a linear interpolation approach to obtain the room impulse response $\{h_{i,j}(0), h_{i,j}(1), \ldots, h_{i,j}(K)\}$ between loudspeaker j and the actual user location i by using the following equation $h_{i,j}(k)=[h_{m1,j}(k)+h_{m2,j}(k)]/2$, k=1, 2, . . . , K. After converting the obtained room impulse response from the time domain to the frequency domain using an FFT approach, the impulse response may be used in Equations (1) to (4).

The system 100 may be configured to determine the room impulse responses in advance. In some examples, the system 100 may determine the database of impulse responses based on information about a shared acoustic environment (e.g., room) in which the loudspeaker array 112 is located. For example, the system 100 may calculate a room impulse response based on a size and configuration of the shared acoustic environment. Additionally or alternatively, the system 100 may output audio using the loudspeaker array 112, capture audio using a microphone array and calculate the database of room impulse responses from the captured audio. For example, the system 100 may determine a plurality of impulse responses between specific loudspeakers in the loudspeaker array 112 and individual microphones in the microphone array. During normal operation, the system 100 may determine a location of a user and generate a virtual microphone based on an actual microphone in proximity to the location. For example, the system 100 may identify a room impulse response between the loudspeaker and the virtual microphone based on a room impulse response between the loudspeaker and the actual microphone in proximity to the location.

Using the individual sound pressure values for each of the microphones in the first microphone array 114*a*, the system 100 may estimate the first overall sound pressure value $p_A(\omega)$ for Zone A using Equation 5:

$$p_A(\omega)=H_A(\omega)q(\omega)=[p_{A,1}(\omega),p_{A,2}(\omega), \ldots p_{A,M_A}(\omega)] \quad (5)$$

where $p_A(\omega)$ is the first overall sound pressure value for Zone A, ω is an angular frequency, $H_A(\omega)$ is the first transfer function described in Equation 3 and q(ω) is the vector of source weighting (e.g., complex frequency response for each of the loudspeakers in the loudspeaker array 112) described above.

Similarly, using the individual sound pressure values for each of the microphones in the second microphone array 114*b*, the system 100 may estimate the second overall sound pressure value $p_B(\omega)$ for Zone B using Equation 6:

$$p_B(\omega)=H_B(\omega)q(\omega)=[p_{B,1}(\omega),p_{B,2}(\omega), \ldots p_{B,M_B}(\omega)] \quad (6)$$

where $p_B(\omega)$ is the second overall sound pressure value for Zone B, ω is an angular frequency, $H_B(\omega)$ is the second transfer function described in Equation 4 and q(ω) is the vector of source weighting (e.g., complex frequency response for each of the loudspeakers in the loudspeaker array 112) described above.

To determine the optimum filters g(k) to separate the ASZ (e.g., Zone A) from the QSZ (e.g., Zone B), the system 100 may solve for q(ω) using two different constraints. For example, the system 100 may determine first filter coefficients f(ω) based on Acoustic Brightness Control (ABC) (e.g., maximizing sound pressure values in the ASZ) and may determine second filter coefficients q(ω) based on Acoustic Contrast Control (ACC) (e.g., maximizing a ratio of a first square of the sound pressure value in the ASZ to a second square of the sound pressure value in the QSZ).

Figure 3A:
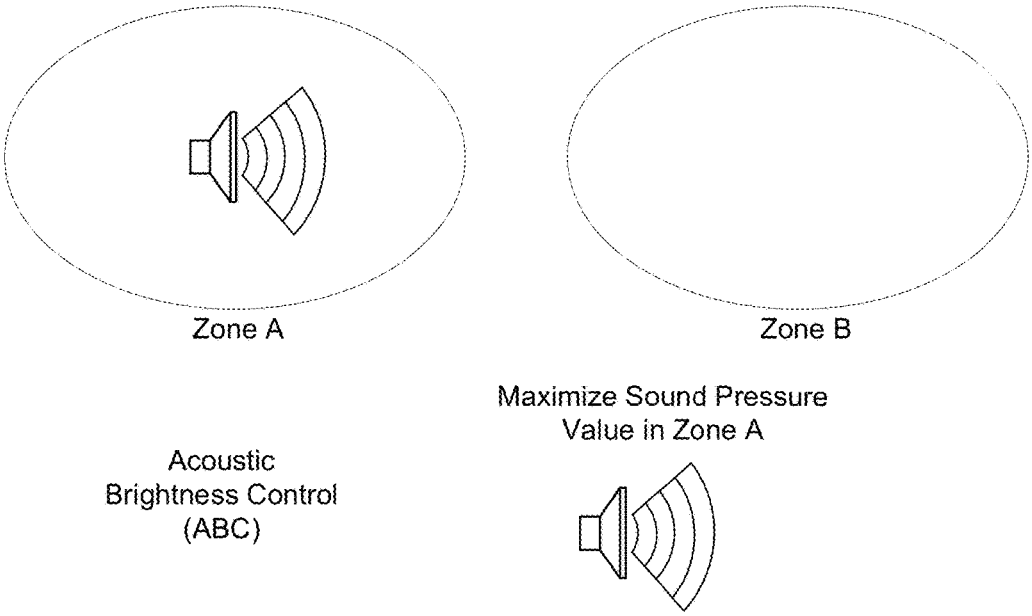
FIGS. 3A-3B illustrate examples of acoustic brightness control and acoustic contrast control.

FIG. 3A illustrates an example of determining the first filter coefficients f(ω) using an Acoustic Brightness Control (ABC) approach, which maximizes a sound pressure value in the ASZ (e.g., Zone A). As illustrated in FIG. 3A, the ABC approach generates first filter coefficients f(ω) that increase the sound pressure value (e.g., volume level) in Zone A without regard to the sound pressure value in Zone B. However, as the sound pressure value in Zone A increases, the sound pressure value in Zone B may also increase, such that a listener in Zone B may hear the audio output 20 at a higher volume than desired.

In order to maximize the sound pressure in augmented sound zone A, the cost function of acoustic brightness control (ABC) is a constrained optimization problem and is defined as follows:

$$F_{ABC}(\omega)=p_A^H(\omega)p_A(\omega)-\alpha(f^H(\omega)f(\omega)-R(\omega)) \quad (7)$$

where $F_{ABC}(\omega)$ is the cost function of ABC, $p_A(\omega)$ is the first overall sound pressure value for Zone A, the superscript H denotes the Hermitian matrix transpose, a is a Lagrange multiplier, f(ω) are the first filter coefficients that will be designed for the loudspeakers in the loudspeaker array 112 (e.g., $LdSpk_1$, $LdSpk_2$ . . . , $LdSpk_L$), and R(ω) denotes a control effort (i.e., constraint on the sum of squared source weights).

To maximize the sound pressure level (SPL) in the ASZ (e.g., Zone A) means to find the maximization of the above ABC cost function by taking the partial derivatives of $F_{ABC}$ with respect to f(ω) and α, respectively, and setting to zero.

The partial derivative $\partial F_{ABC}(\omega)/\partial f(\omega)=0$ results in:

$$H^H_A(\omega)H_A(\omega)f(\omega)-\alpha f(\omega)=0 \quad (8)$$

which is actually an eigen-decomposition problem. In other words, the optimal source weight vector f(ω) can be solved by finding the eigenvector f'(ω) corresponding to the maximum eigenvalue of $H^H_A(\omega)H_A(\omega)$. This optimization problem is then equivalent to:

$$\alpha=\frac{f^H(\omega)H_A^H(\omega)H_A(\omega)f(\omega)}{f^H(\omega)f(\omega)}=\frac{p_A^H(\omega)p_A(\omega)}{f^H(\omega)f(\omega)} \quad (9)$$

The partial derivative $\partial F_{ABC}(\omega)/\partial\alpha=0$ results in:

$$f^H(\omega)f(\omega)=R(\omega) \quad (10)$$

which will be used to solve the above eigen-decomposition problem. Thus, the system 100 may use Equation 7 to solve for the first filter coefficients f(ω).

Figure 3B:
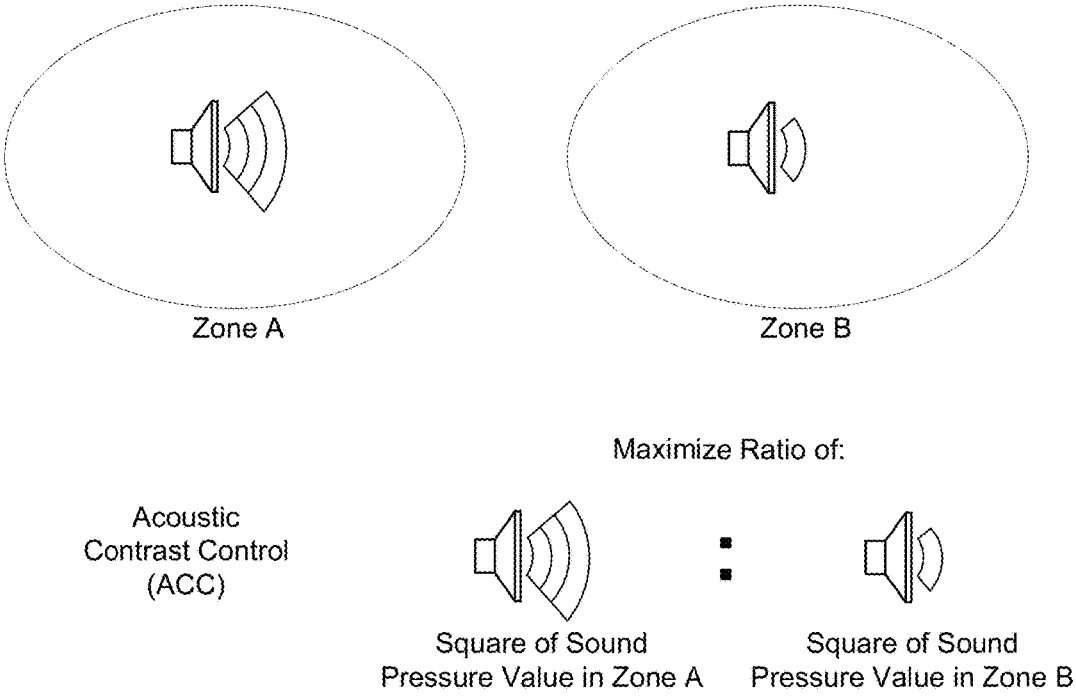

In contrast, FIG. 3B illustrates an example of determining the second filter coefficients q(ω) using an Acoustic Contrast Control (ACC) approach, which maximizes a ratio between the sound pressure value in Zone A and the sound pressure value in Zone B. As illustrated in FIG. 3B, the ACC approach generates second filter coefficients q(ω) that increase the sound pressure value (e.g., volume level) in Zone A with regard to the sound pressure value in Zone B in order to maximize a ratio between the two. Thus, a listener in Zone B may hear the audio output 20 at a desired volume level that is lower than the volume level using the first filter coefficients f(ω). In addition, the system 100 may apply a power constraint to the ACC approach to ensure that the loudspeaker array 112 will not produce very large volume velocities, and that numerical analyses are robust to system errors (such as position errors or mismatching of loudspeakers).

Maximizing the ratio of the squared sound pressures between two zones is mapped to the optimization of the cost function of ACC with a constrained term as shown in Equation 11:

$$F_{ACC,1}(\omega)=p_A^H(\omega)p_A(\omega)-\beta(p_B^H(\omega)p_B(\omega)-K_B(\omega)) \quad (11)$$

where $F_{ACC,1}(\omega)$ is a first cost function of ACC, $p_A(\omega)$ is the first overall sound pressure value for zone A, the superscript H denotes the Hermitian matrix transpose, β is a Lagrange multiplier, $P_B(\omega)$ is the second overall sound pressure value for Zone B, and $K_B(\omega)$ is a constraint on the sum of squared pressures in Zone B. With this, the solution of this optimization problem is the desired set of filters q(ω) by which the sound level ratio between Zone A and Zone B can be maximized.

Like Equation (8), the partial derivative $\partial F_{ACC,1}(\omega)/\partial q(\omega)=0$ results in an eigen-decomposition problem as follows:

$$H^H_A(\omega)H_A(\omega)q(\omega)-\beta H^H_B(\omega)H_B(\omega)q(\omega)=0 \quad (12)$$

$$q^H(\omega)H^H_A(\omega)H_A(\omega)q(\omega)-\beta q^H(\omega)H^H_B(\omega)H_B(\omega)q(\omega)=0 \quad (13)$$

From Eq. (12), we can obtain the ratio that is maximized:

$$\beta=\frac{p_A^H(\omega)p_A(\omega)}{p_B^H(\omega)p_B(\omega)}=\frac{q^H(\omega)H_A^H(\omega)H_A(\omega)q(\omega)}{q^H(\omega)H_B^H(\omega)H_B(\omega)q(\omega)} \quad (14)$$

The optimal source weight vector q(ω) can be solved by finding the eigenvector q'(ω) corresponding to the maximum eigenvalue of $[(H^H_B(\omega)H_B(\omega))^{-1}(H^H_A(\omega)H_A(\omega))]$.

In addition, the system 100 may add a power constraint into the cost function so as to ensure that the loudspeaker array 112 will not produce very large volume velocities, and that numerical analyses are robust to system errors (such as position errors or mismatching of loudspeakers), as shown in the following two equations:

$$F_{ACC,2}(\omega)=p_A^H(\omega)p_A(\omega)-\beta(p_B^H(\omega)p_B(\omega)-K_B(\omega))-\alpha(q^H(\omega)q(\omega)-R(\omega)), \quad (15)$$

where $F_{ACC,2}(\omega)$ is a second cost function of ACC, $p_A(\omega)$ is the first overall sound pressure value for zone A, the superscript H denotes the Hermitian matrix transpose, β is a Lagrange multiplier, $P_B(\omega)$ is the second overall sound pressure value for Zone B, $K_B(\omega)$ is a constraint on the sum of squared pressures in Zone B, a is a Lagrange multiplier, q(ω) are the second filter coefficients, and R(ω) denotes a control effort (i.e., constraint on the sum of squared source weights).

$$F_{ACC,3}(\omega)=p_B^H(\omega)p_B(\omega)-\beta(p_A^H(\omega)p_A(\omega)-K_A(\omega))+\alpha(q^H(\omega)q(\omega)-R(\omega)), \quad (16)$$

where $F_{ACC,3}(\omega)$ is a third cost function of ACC, $p_B(\omega)$ is the second overall sound pressure value for Zone B, the superscript H denotes the Hermitian matrix transpose, β is a Lagrange multiplier, $p_A(\omega)$ is the first overall sound pressure value for zone A, $K_A(\omega)$ is a constraint on the sum of squared pressures in Zone A, α is a Lagrange multiplier, q(ω) are the second filter coefficients, and R(ω) denotes a control effort (i.e., constraint on the sum of squared source weights).

Equation (16) avoids computing the inverse of $H^H_B(\omega)H_B(\omega)$ and hence has a robust numerical properties. To minimize Equation (16) is to take the derivatives with respect to q(ω), and both Lagrange multipliers β and α respectively, and setting to zero. The partial derivative $\partial F_{ACC,3}(\omega)/\partial q(\omega)=0$ results in an eigen-decomposition problem:

$$H^H_B(\omega)H_B(\omega)q(\omega)-\beta H^H_A(\omega)H_A(\omega)q(\omega)+\alpha Iq(\omega)=0 \quad (17)$$

where I is an identity matrix.

$$\beta\cdot q(\omega)=\frac{(H_B^H(\omega)H_B(\omega)+\alpha I)q(\omega)}{H_A^H(\omega)H_A(\omega)} \quad (18)$$

Therefore, the optimal source weight vector q(ω) can be solved by finding the eigenvector q'(ω) corresponding to the minimum eigenvalue of $[(H^H_A(\omega)H_A(\omega))^{-1}(H^H_B(\omega)H_B(\omega)+\alpha I)]$.

The partial derivatives $\partial F_{ACC,3}(\omega)/\partial\alpha=0$ and $\partial F_{ACC,3}(\omega)/\partial\beta=0$ result in $$q^H(\omega)q(\omega)-R(\omega)=0 \quad (19)$$

$$p_A^H(\omega)p_A(\omega)-K_A(\omega)=0 \quad (20)$$

which will be used to solve the above eigen-decomposition problem (e.g., Equation (18)).

The system 100 may determine global filter coefficients G(ω) (e.g., a globally optimal source weight vector) using a combination of the first filter coefficients f(ω) and the second filter coefficients q(ω). For example, the system 100 may determine the first filter coefficients f(ω) using Equation (7), determine second filter coefficients q(ω) using Equation (16) and may determine the global filter coefficients G(ω) using a weighted sum of the first filter coefficients f(ω) and the second filter coefficients q(ω), as shown in Equation 21:

$$G(\omega)=\mu f(\omega)+\xi q(\omega) \quad (21)$$

where μ is a first weighting coefficient for the first filter coefficients f(ω), ξ is a second weighting coefficient for the second filter coefficients q(ω), and μ and ξ range from 0.0 to 1.0.

The system 100 may determine the first weighting coefficient μ and the second weighting coefficient ξ based on a variety of different factors, such as a user experience (e.g., audio quality), an amount of audio suppression in the quiet sound zone (e.g., a maximum volume level), an amount of ambient noise from surrounding devices, and/or the like. In some examples, the system 100 may select the weighting coefficients based on user preferences. For example, a first user may prefer the quiet sound zone to have a lower volume level and the system 100 may increase the second weighting coefficient ξ for the second filter coefficients q(ω) relative to the first weighting coefficient μ of the first filter coefficients f(ω), increasing a ratio of the sound pressure value in Zone A relative to the sound pressure value in zone B. In contrast, a second user may prefer that the augmented sound zone be louder, even at the expense of the quiet sound zone, and the system 100 may increase the first weighting coefficient μ relative to the second weighting coefficient ξ, increasing a sound pressure value in Zone A without regard to Zone B.

Additionally or alternatively, a third user may care about audio quality and the system 100 may increase the second weighting coefficient ξ relative to the first weighting coefficient μ, increasing an audio quality of the audio in Zone A. In contrast, a fourth user may not be sensitive to audio quality and/or may not be able to distinguish the audio and may the system 100 may increase the first weighting coefficient μ relative to the second weighting coefficient increasing the sound pressure value of the audio in Zone A.

The system 100 may generate global filter coefficients G(ω) for each audio source. For example, if the system 100 is generating audio output for a single audio source, the system 100 may generate the global filter coefficients G(ω)

using Equation (21) and may use the global filter coefficients $G(\omega)$ to generate the audio output. However, if the system 100 is generating first audio output for a first audio source and second audio output for a second audio source, the system 100 may generate first global filter coefficients $G_1(\omega)$ for the first audio source and generate second global filter coefficients $G_2(\omega)$ for the second audio source. The system 100 may apply the first global filter coefficients $G_1(\omega)$ to first audio data associated with the first audio source to generate the first audio output and may apply the second global filter coefficients $G_2(\omega)$ to second audio data associated with the second audio source to generate the second audio output. The system 100 may then sum the first audio output and the second audio output for each loudspeaker in the loudspeaker array 112 in order to generate an input to the loudspeaker array 112, as described in greater detail below with regard to FIG. 6.

The system 100 may generate L FIR filters, corresponding to the L loudspeakers, by converting the global filter coefficients $G(\omega)$ (e.g., vector of complex frequency responses) into a vector of FIR filters $g(k)$ with filter length N (e.g., k=1, 2, . . . , N). As a final step, the system 100 may apply the L FIR filters to the output audio data 10 before digital to analog convertors and generate the loudspeaker signals that create the audio output 20. Therefore, by jointly addressing the acoustic brightness control (ABC) and the acoustic contrast control (ACC) using global optimization, the system 100 may precisely control a sound field with a desired shape and energy distribution, such that a listener can experience high sound level (e.g., first audio output 20*a*) in the ASZ (e.g., Zone A) and a low sound level (e.g., second audio output 20*b*) in the QSZ (e.g., Zone B). Thus, the acoustic energy is focused on only a specific area (ASZ) while being minimized in the remaining areas of a shared acoustic space (e.g., QSZ).

As illustrated in FIG. 1, the system 100 may determine (120) a target zone and determine (122) a quiet zone. For example, FIG. 1 illustrates the system 100 selecting Zone A as the target zone (e.g., Augmented Sound Zone) and selecting Zone B as the quiet zone (e.g., Quiet Sound Zone).

The system 100 may determine (124) transfer functions associated with the target zone and may determine (126) transfer functions associated with the quiet zone. For example, the system 100 may determine a first transfer function matrix $H_A(\omega)$ for Zone A and a second transfer function matrix $H_B(\omega)$ for Zone B, as described above with regard to Equations (3) and (4). Thus, the system 100 may determine a transfer function $H_{A,m_{Al}}(\omega)$ between a loudspeaker $LdSpk_l$ and a microphone $m_A$ in the first microphone array 114*a*, and a transfer function $H_{B,m_{Bl}}(\omega)$ between the loudspeaker $LdSpk_l$ and a microphone $m_B$ in the second microphone array 114*b*.

The system 100 may determine (128) first filter coefficients $f(\omega)$ using the ABC approach, which maximizes a first sound pressure value (e.g., volume level) in the target zone (e.g., Zone A) without regard to a second sound pressure value in the quiet zone. For example, the system 100 may determine the first filter coefficients $f(\omega)$ using Equation (7) discussed above. Similarly, the system 100 may determine (130) second filter coefficients $q(\omega)$ using the ACC approach, which maximizes a ratio between the first sound pressure value and the second sound pressure value. For example, the system 100 may determine the second filter coefficients $q(\omega)$ using Equation (16) discussed above.

The system 100 may determine (132) global filter coefficients $G(\omega)$ using a combination of the first filter coefficients $f(\omega)$ and the second filter coefficients $q(\omega)$. For example, the system 100 may use a weighted sum of the first filter coefficients $f(\omega)$ and the second filter coefficients $q(\omega)$, as discussed with regard to Equation (21).

The system 100 may generate (134) the audio output 20 using the loudspeaker array 112. For example, system 100 may convert the global filter coefficients $G(\omega)$ into a vector of FIR filters $g(k)$ (e.g., $g_1(k)$, $g_2(k)$, $g_1(k)$) and may apply the filters $g(k)$ to the output audio data 10 before generating the audio output 20 using the loudspeaker array 112.

Figure 4A:
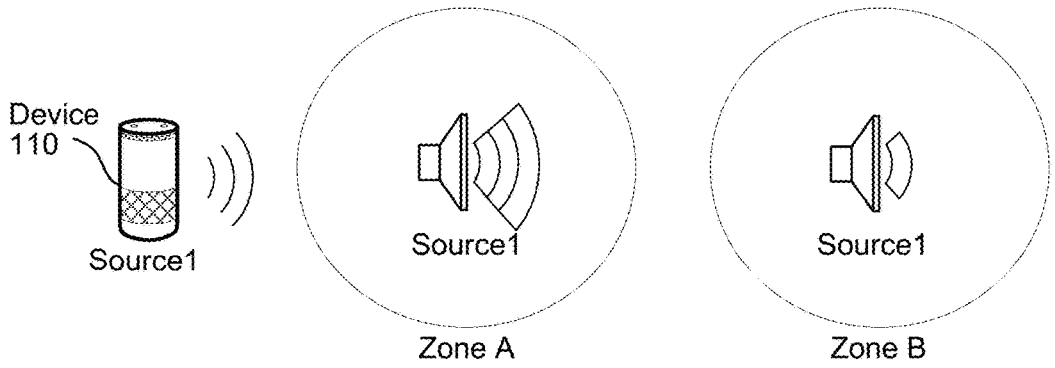
FIGS. 4A-4C illustrate examples of generating unique audio output for each sound zone using a single device or multiple devices according to examples of the present disclosure.

FIG. 4A illustrates an example of a single device 110 generating audio output from a first audio source (e.g., Source 1). As illustrated in FIG. 4A, the device 110 may direct the first audio output to a target zone (e.g., Zone A) and away from a quiet zone (e.g., Zone B), such that a listener may hear the first audio output at a high volume level in Zone A and at a low volume level in Zone B.

In some examples, the device 110 may generate audio output at different volume levels in different sound zones using the first audio source. For example, the device 110 may generate first audio from the first audio source at a first volume level in the target zone (e.g., Zone A) and may generate second audio from the first audio source at a second volume level in the quiet zone (e.g., Zone B). Thus, while both the target zone and the quiet zone are receiving audio from the first audio source, the first volume level and the second volume level may be drastically different. To illustrate an example, a first user may listen to audio at a normal volume level while a second user may be hard of hearing and listen to audio at a high volume level. Instead of outputting the audio at the normal volume level, which the second user cannot hear properly, or outputting the audio at the high volume level, which is too loud for the first user, the device 110 may generate audio at the normal volume level in the first zone for the first user and at the high volume level in the second zone for the second user.

While FIG. 4A illustrates an example of generating audio output from a single audio source, the disclosure is not limited thereto and the system 100 may generate audio output using two or more audio sources without departing from the disclosure. For example, the system 100 may generate first audio output from a first audio source in the shared acoustic space (e.g., Zone A and Zone B) while directing second audio output from a second audio source to a target zone (e.g., Zone A). Thus, a listener may hear the first audio output and the second audio output in Zone A and only hear the first audio output in Zone B. Additionally or alternatively, the system 100 may determine a target zone and a quiet zone for each of the audio sources. For example, the system 100 may direct the first audio output to a first target zone (e.g., Zone A) and may direct the second audio output to a second target zone (e.g., Zone B). Thus, the system 100 may select Zone A as the first target zone and Zone B as a first quiet zone for the first audio source, while selecting Zone B as the second target zone and Zone A as a second quiet zone for a second audio source. Thus, a listener may hear the first audio output in Zone A and the second audio output in Zone B.

In some examples, the system 100 may generate the audio output using two or more loudspeaker arrays. For example, a first loudspeaker array may generate the first audio output associated with the first audio source in Zone A by selecting a first target zone (e.g., Zone A) and a first quiet zone (e.g., Zone B). Concurrently, a second loudspeaker array may generate the second audio output associated with the second audio source in Zone B by selecting a second target zone (e.g., Zone B) and a second quiet zone (e.g., Zone A). Thus, the first loudspeaker array may direct the first audio output to the first target zone (e.g., Zone A) and the second loudspeaker array may direct the second audio output to the second target zone (e.g., Zone B). For example, the first loudspeaker array may be associated with a television and the first audio output may correspond to content displayed on the television, whereas the second loudspeaker array may be associated with a music streaming device and the second audio output may correspond to music. Therefore, a listener in Zone A may hear the first audio output while watching the television while allowing a listener in Zone B to hear the music and not the first audio output.

Figure 4B:
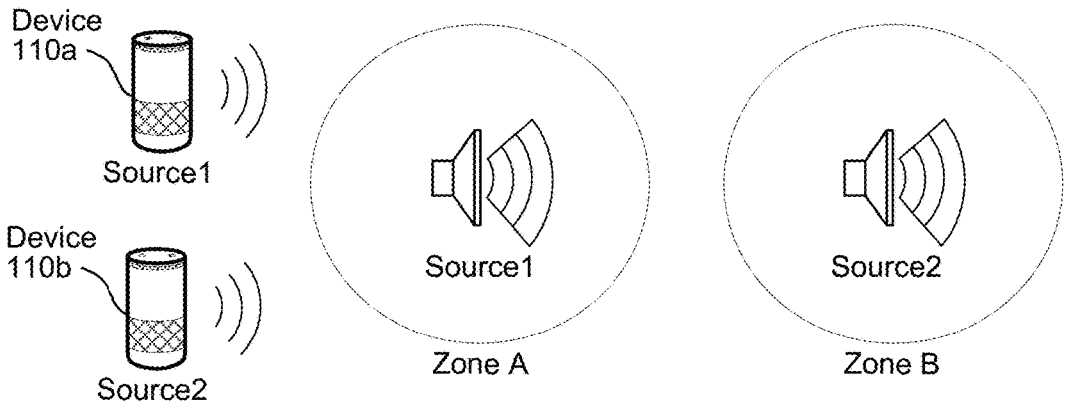

FIG. 4B illustrates an example of two devices 110 generating audio output from two audio sources. As illustrated in FIG. 4B, a first device 110*a* may generate first audio output from a first audio source (e.g., Source 1) and a second device 110*b* may generate second audio output from a second audio source (e.g., Source 2). For example, the first device 110*a* may direct the first audio output to a first target zone (e.g., Zone A) and away from a first quiet zone (e.g., Zone B) while the second device 110*b* may direct the second audio output to a second target zone (e.g., Zone B) and away from a second quiet zone (e.g., Zone A). Thus, a listener may hear the first audio output at a high volume level in Zone A and may hear the second audio output at a high volume in Zone B.

While FIG. 4B illustrates the system 100 generating the audio output using two or more loudspeaker arrays, the disclosure is not limited thereto and a single loudspeaker array 112 may generate both the first audio output and the second audio output without departing from the disclosure.

Figure 4C:
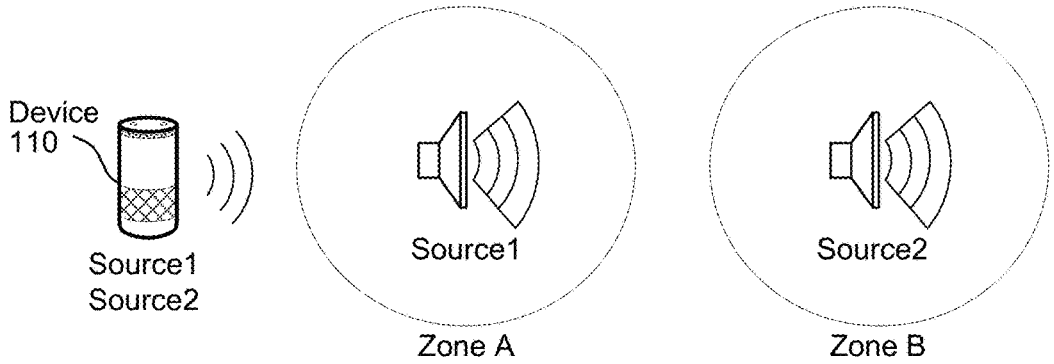

FIG. 4C illustrates an example of a single device generating audio output from two audio sources. As illustrated in FIG. 4C, the device 110 may generate first audio output from a first audio source (e.g., Source 1) and generate second audio output from a second audio source (e.g., Source 2). For example, the device 110 may direct the first audio output to a first target zone (e.g., Zone A) and away from a first quiet zone (e.g., Zone B) while directing the second audio output to a second target zone (e.g., Zone B) and away from a second quiet zone (e.g., Zone A). Thus, a listener may hear the first audio output at a high volume level in Zone A and may hear the second audio output at a high volume in Zone B, despite the system 100 generating the first audio output and the second audio output using a single device 110.

While FIGS. 4A-4C illustrate the system 100 dividing the shared acoustic environment (e.g., area, room, etc.) into two sound zones (e.g., Zone A and Zone B), the disclosure is not limited thereto and the system 100 may divide the shared acoustic environment into three or more sound zones without departing from the disclosure. For example, one or more loudspeaker arrays 112 may divide the shared acoustic environment into three or more sound zones and may select one or more of the sound zones as an ASZ and one or more of the sound zones as a QSZ for each audio source.

Figure 5A:
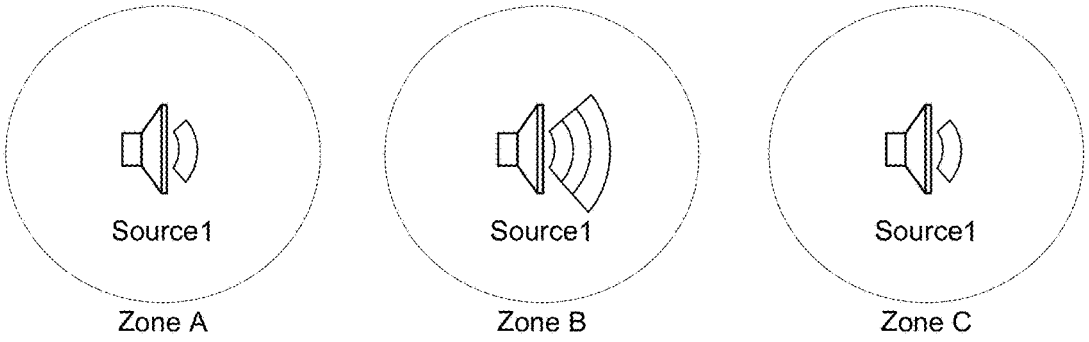
FIGS. 5A-5C illustrate examples of audio output configurations for multiple sound zones according to examples of the present disclosure.
Figure 5B:
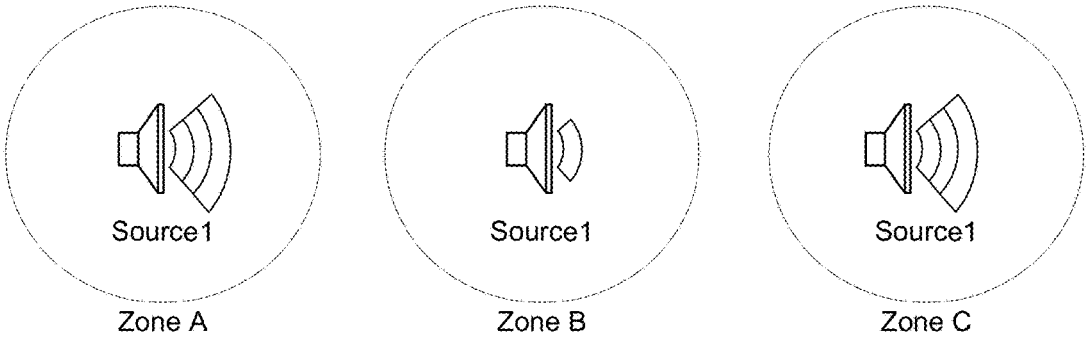
Figure 5C:
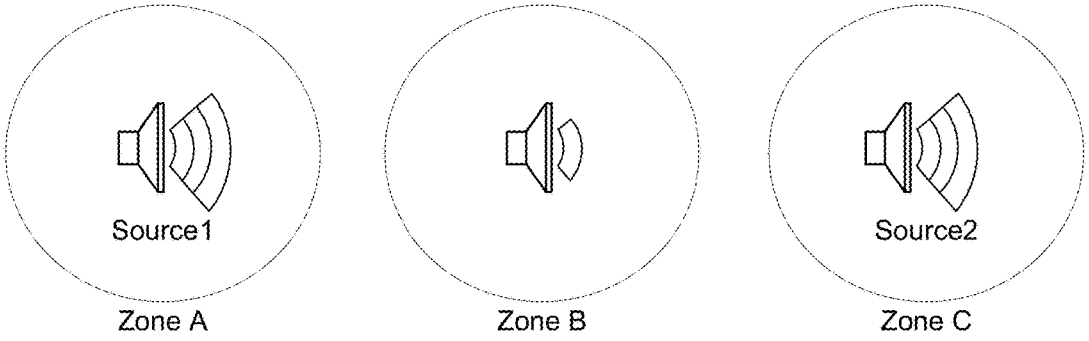

FIGS. 5A-5C illustrate examples of audio output configurations for multiple sound zones according to examples of the present disclosure. As illustrated in FIG. 5A, the system 100 may divide the shared acoustic environment into three sound zones (e.g., Zone A, Zone B and Zone C) and may identify the sound zones as QSZ, ASZ and QSZ, such that the system 100 directs audio output to Zone B (e.g., the audio output can be heard at a high volume level in Zone B) and away from Zone A and Zone C (e.g., the audio output can be heard at a low volume level in Zone A and Zone C).

Additionally or alternatively, FIG. 5B illustrates an example of the system 100 dividing the shared acoustic environment into the three sound zones and identifying the sound zones as ASZ, QSZ and ASZ, such that the system 100 directs the audio output to Zone A and Zone C (e.g., the audio output can be heard at a high volume level in Zone A and Zone C) and away from Zone B (e.g., the audio output can be heard at a low volume level in Zone B). As can be understood by one of skill in the art, the system 100 may select any combination of ASZ(s) and/or QSZ(s) without departing from the disclosure.

In some examples, the system 100 may generate audio in three or more sound zones using two or more audio sources. In order to direct the audio output correctly, the system 100 may identify the target zone(s) and quiet zone(s) separately for each audio source. For example, one or more loudspeaker arrays 112 may separate a shared acoustic environment (e.g., area, room, etc.) into three or more sound zones and may select one or more of the sound zones as first target zone(s) associated with a first audio source, one or more sound zones as first quiet zone(s) associated with the first audio source, one or more of the sound zones as second target zone(s) associated with a second audio source, and/or one or more sound zones as second quiet zone(s) associated with the second audio source. Thus, the system 100 may generate first audio output associated with the first audio source at high volume levels in a sound zone included in the first target zone(s) and the second quiet zone(s), may generate second audio output associated with the second audio source at high volume levels in a sound zone included in the second target zone(s) and the first quiet zone(s), may generate the first audio output and the second audio output at low volume levels in a sound zone included in the first quiet zone(s) and the second quiet zone(s), and may generate the first audio output and the second audio output at high volume levels in a sound zone included in the first target zone(s) and the second target zone(s).

FIG. 5C illustrates an example of the system 100 dividing the shared acoustic environment into the three sound zones and directing a first audio output from a first audio source to Zone A and directing a second audio output from a second audio source to Zone C. For each audio source, the system 100 may select one or more target zones and the remaining sound zones may be selected as quiet zones. For example, the system 100 may select the first zone (e.g., Zone A) as a target zone for the first audio source while selecting a second zone (e.g., Zone B) and a third zone (e.g., Zone C) as quiet zones for the first audio source. Similarly, the system 100 may select the third zone (e.g., Zone C) as a second target zone for the second audio source while selecting the first zone (e.g., Zone A) and the second zone (e.g., Zone B) as quiet zones for the second audio source.

Thus, the system 100 directs the first audio output to Zone A (e.g., the first audio output is generated at high volume levels in Zone A) and away from Zone B and Zone C (e.g., the first audio output is generated at low volume levels in Zone B and Zone C) while directing the second audio output to Zone C (e.g., the second audio output is generated at high volume levels in Zone C) and away from Zone A and Zone B (e.g., the second audio output is generated at low volume levels in Zone A and Zone B). As a result, listeners in Zone A may hear the first audio output at high volume levels, listeners in Zone B may hear the first audio output and/or the second audio output at low volume levels, and listeners in Zone C may hear the second audio output at high volume levels.

While the above examples illustrate the system 100 dividing the area into three sound zones and describe the audio output generated in each of the three sound zones, the disclosure is not limited thereto. Instead, the system 100 may divide the area into a plurality of sound zones and may generate audio output in each of the sound zones from any number of audio sources using any number of loudspeaker arrays 112 without departing from the disclosure. For example, the system 100 may divide the area into four or more sound zones and/or the system 100 may generate audio output in any combination of the sound zones without departing from the disclosure. Additionally or alternatively, the system 100 may generate audio output using any configuration of audio sources and/or the loudspeaker array(s) 112 without departing from the disclosure.

Figure 6:
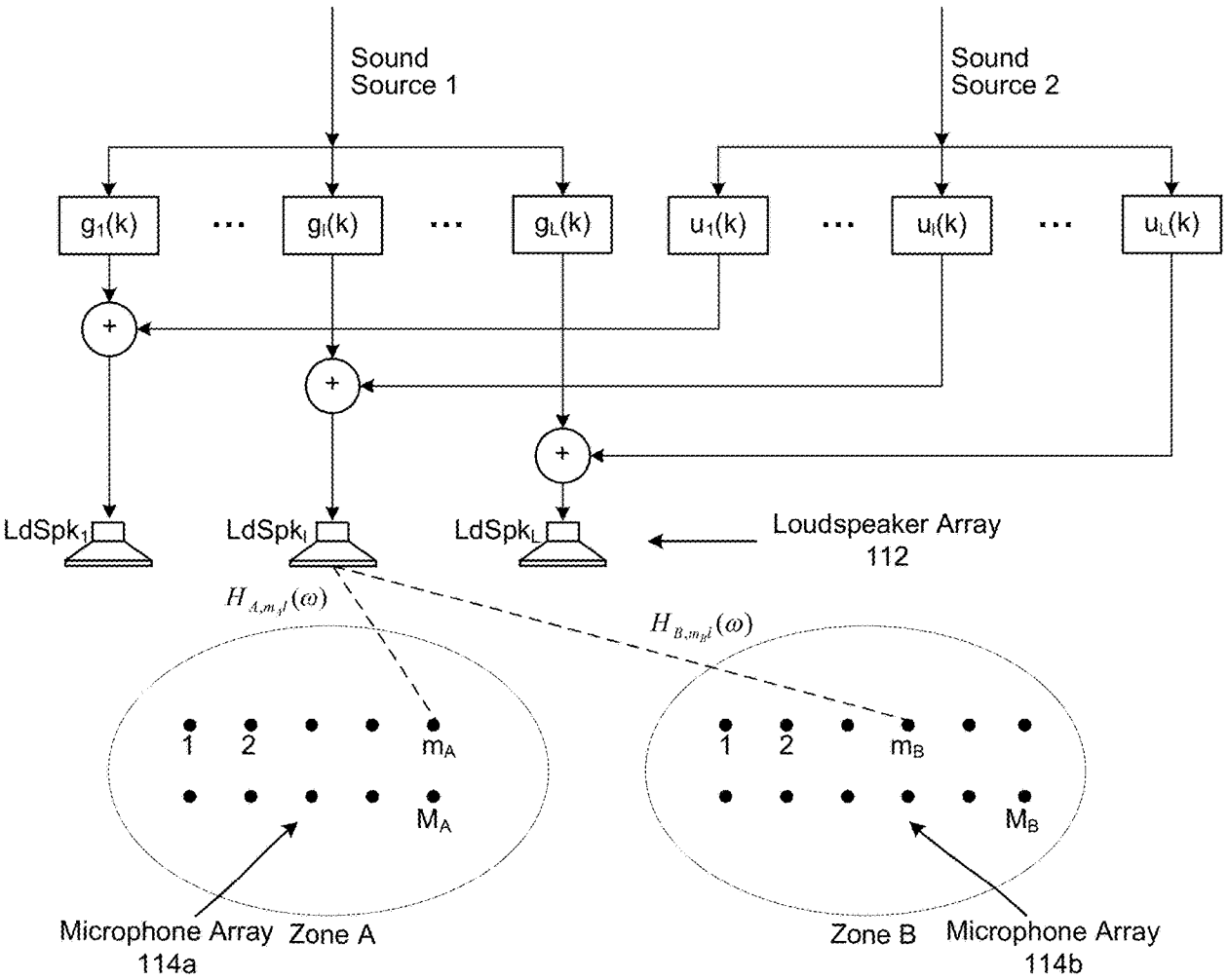
FIG. 6 illustrates an example of generating output zones from multiple sound sources using a single loudspeaker array according to examples of the present disclosure.

FIG. 6 illustrates an example of generating output zones from multiple independent sound sources using a single loudspeaker array according to examples of the present disclosure. As illustrated in FIG. 6, the system 100 may perform the techniques described above to generate first global filter coefficients $G_1(\omega)$ (e.g., $g_1(\omega) \ldots g_l(\omega) \ldots g_L(\omega)$) associated with a first audio source (e.g., Sound Source 1). Separately, the system 100 may perform the techniques described above to generate second global filter coefficients $G_2(\omega)$ (e.g., $u_1(\omega) \ldots u_1(\omega) \ldots u_1(\omega)$) associated with a second audio source (e.g., Sound Source 2). The system 100 may then apply the first global filter coefficients $G_1(\omega)$ (e.g., $g_1(\omega) \ldots g_1(\omega) \ldots g_1(\omega)$) to first audio data associated with the first audio source (e.g., Sound Source 1) to generate first audio output and may apply the second global filter coefficients $G_2(\omega)$ (e.g., $u_1(\omega) \ldots u_l(\omega)$ $u_L(\omega)$) to second audio data associated with the second audio source (e.g., Sound Source 2) to generate second audio output. The system 100 may sum the first audio output and the second audio output for each loudspeaker in the loudspeaker array 112 in order to generate an input to the loudspeaker array 112.

While FIG. 6 only illustrates two sound sources, the disclosure is not limited thereto and the number of sound sources may vary without departing from the disclosure. For example, the system 100 may apply first global filter coefficients $G_1(\omega)$ to first audio data associated with a first audio source to generate first audio output, may apply second global filter coefficients $G_2(\omega)$ to second audio data associated with a second audio source to generate second audio output, and may apply third global filter coefficients $G_3(\omega)$ to third audio data associated with a third audio source to generate third audio output. The system 100 may then sum the first audio output, the second audio output and the third audio output for each loudspeaker in the loudspeaker array 112 in order to generate an input to the loudspeaker array 112.

Figure 7:
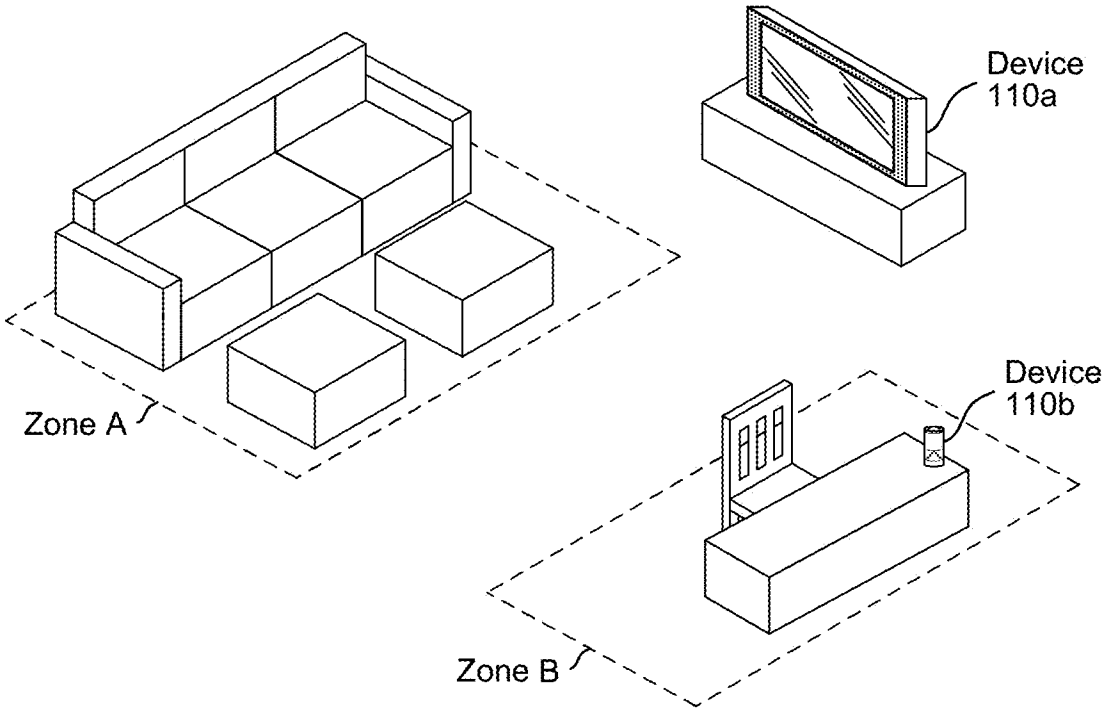
FIG. 7 illustrates an example of output zones in a shared acoustic environment according to examples of the present disclosure.

FIG. 7 illustrates an example of output zones in a shared acoustic environment according to examples of the present disclosure. In the example illustrated in FIG. 7, the system 100 may generate audio output using two or more audio sources. For example, a first device 110*a* (e.g., television) may be displaying video content and a first audio source (e.g., audio corresponding to the video content) may be associated with Zone A, while a second audio source (e.g., streaming music) may be associated with Zone B.

In some examples, the system 100 may generate first output audio associated with the first audio source using a first loudspeaker array included in the first device 110*a*, while generating second audio output associated with the second audio source using a second loudspeaker array included in the second device 110*b* (e.g., audio playback device). For example, the first loudspeaker array may generate the first audio output in Zone A by selecting a first ASZ (e.g., Zone A) and a first QSZ (e.g., Zone B). Concurrently, the second loudspeaker array may generate the second audio output in Zone B by selecting a second ASZ (e.g., Zone B) and a second QSZ (e.g., Zone A). Thus, the first loudspeaker array may direct the first audio output to the first ASZ (e.g., Zone A) and the second loudspeaker array may direct the second audio output to the second ASZ (e.g., Zone B). For example, the first loudspeaker array may be coupled to the television and the first audio output may correspond to content displayed on the television, whereas the second loudspeaker array may be included in the second device 110*b* and the second audio output may correspond to music, allowing listeners in Zone A to hear the first audio output while watching the television while allowing listeners in Zone B to hear the music and not the first audio output.

However, the disclosure is not limited thereto and a single loudspeaker array 112 may generate both the first audio output and the second audio output without departing from the disclosure. For example, the loudspeaker array may generate the first audio output in Zone A by selecting a first ASZ (e.g., Zone A) and a first QSZ (e.g., Zone B) and may generate the second audio output in Zone B by selecting a second ASZ (e.g., Zone B) and a second QSZ (e.g., Zone A). Thus, the loudspeaker array may direct the first audio output to the first ASZ (e.g., Zone A) and the second audio output to the second ASZ (e.g., Zone B).

In some examples, the system 100 may divide the shared acoustic environment into multiple sound zones and the sound zones may be associated with specific audio sources, devices and/or loudspeaker arrays in advance in a specific configuration. For example, a first sound zone (e.g., Zone A) may be associated with a first audio source (e.g., video content displayed on the television), the first device 110*a* and/or a first loudspeaker array included in the first device 110*a*. Thus, the system 100 may select the first sound zone whenever generating audio output from the first audio source, using the first device 110*a* and/or using the first loudspeaker array. Similarly, a second sound zone (e.g., Zone B) may be associated with a second audio source (e.g., music content), the second device 110*b* and/or a second loudspeaker array included in the second device 110*b*. Thus, the system 100 may select Zone B whenever generating audio output from the second audio source, using the second device 110*b* and/or using the second loudspeaker array.

In some examples, the system 100 may determine the ASZs and/or the QSZs based on input from listener(s). For example, the system 100 may receive an input command selecting sound zones as ASZs for a first audio source, ASZs for a second audio source, QSZs for the first audio source and/or the second audio source, or the like. Thus, the listener can indicate which source to associate with each sound zone and may indicate that a sound zone should not be associated with any audio source. For example, the system 100 may receive an input command selecting Zone A as an ASZ for a first audio source (e.g., generate first audio output directed to Zone A), selecting Zone B as a QSZ for the first audio source (e.g., don't generate the first audio output for Zone B), selecting Zone B as an ASZ for a second audio source (e.g., generate second audio output directed to Zone B), selecting Zone C as a QSZ for the first audio source and the second audio source (e.g., don't generate any audio output for Zone C), or the like.

In some examples, the system 100 may divide the shared acoustic environment into multiple sound zones in advance and may select one or more ASZs and one or more QSZs based on location(s) of listener(s) in the shared acoustic environment. For example, the system 100 may divide the shared acoustic environment into two sound zones (e.g., Zone A and Zone B) and may determine if listeners are present in the sound zones. Thus, if the system 100 identifies a single listener in Zone A and receives a command to generate first audio output from a first audio source (e.g., video content, music content, etc.), the system 100 may generate the first audio output in Zone A and Zone B without selecting an ASZ or a QSZ. However, the disclosure is not limited thereto and the system 100 may select Zone A as an ASZ and Zone B as a QSZ and direct the first audio output to Zone A based on the location of the listener.

In some examples, the system 100 may identify a first listener in Zone A and a second listener in Zone B and receive a command to generate the first audio output from the first audio source (e.g., video content) and second audio output from a second audio source (e.g., music content). Thus, the system 100 may select Zone A as a first ASZ and Zone B as a first QSZ for the first audio source and may select Zone B as a second ASZ and Zone C as a second QSZ for the second audio source, generating the first audio output in Zone A and the second audio output in Zone B. Additionally or alternatively, the system 100 may determine a likelihood that the first listener and the second listener are both interested in the first audio output and/or the second audio output and may select the ASZ and the QSZ for the first audio source and/or the second audio source accordingly. For example, the system 100 may determine that the second listener is passively watching the video content displayed on the first device 110*a* while listening to the music and may select Zone A and Zone B as the first ASZ for the first audio source.

The system 100 may identify the listener(s) and/or location(s) of the listener(s) using image data captured by a camera, audio data captured by microphone(s), thermal imaging (e.g., IR sensors), motion detectors or other sensors known to one of skill in the art. For example, the system 100 may capture audio data using a microphone array included in the second device 110*b*, may detect a speech command corresponding to the first listener and may determine a location of the first listener (e.g., Zone A). Thus, when the speech command instructs the system 100 to generate first audio output, the system 100 may direct the first audio output to Zone A. In some examples, the system 100 may identify the listener(s) and/or determine location(s) of the listener(s) using a first device and may generate the audio using a second device. For example, the device 110 may receive a user location from a separate device without departing from the disclosure.

In some examples, the system 100 may determine ASZs and/or QSZs based on user preferences and historical data. For example, the system 100 may determine that the listener(s) typically listen to the first audio source in first sound zones and may store the first sound zones to be selected as ASZs for the first audio source. Similarly, the system 100 may determine that the listener(s) typically listen to the second audio source in second sound zones and may store the second sound zones to be selected as ASZs for the second audio source. Additionally or alternatively, the system 100 may learn how the listener prefers to generate first audio output and second audio output at the same time. For example, a first listener may prefer distinct ASZs (e.g., generating the first audio output in Zone A and the second audio output in Zone B), whereas a second listener may prefer multitasking (e.g., generating the first audio output and the second audio output in Zone B).

In some examples, the system 100 may dynamically determine the ASZs/QSZs based on a location of a listener. For example, the system 100 may associate a first audio source with a first listener and may direct first audio output associated with the first audio source to a location of the first listener. Thus, when the first listener is in Zone A, the system 100 may select Zone A as an ASZ for the first audio source and select Zone B as a QSZ for the first audio source, directing the first audio output to the first listener in Zone A. If the first listener moves to Zone B, the system 100 may select Zone B as the ASZ and select Zone A as the QSZ, directing the first audio output to the first listener in Zone B. Therefore, the system 100 may dynamically determine the sound zones to which to direct audio output based on detecting location(s) of the listener(s).

In some examples, the system 100 may generate audio from two audio sources in a single audio zone. For example, a first audio source may correspond to music content or video content displayed on a television and the system 100 may generate first audio output in Zone A and Zone B. Thus, the first audio output may be generated without using an ASZ and QSZ, although the disclosure is not limited thereto. The second audio source may correspond to text-to-speech or other audio specific to a single listener and the system 100 may generate second audio output based on a location of the listener (e.g., in Zone A if the listener is located in Zone A). Thus, the system 100 may generate the second audio output (e.g., text-to-speech) for the specific listener and may direct the second audio output to the specific listener (e.g., Zone A) instead of generating the second audio output in all zones (e.g., Zone A and Zone B). For example, the first audio output may correspond to streaming music and a listener may input a command (e.g., speech command, input command via remote control, etc.) to the system 100 to control the streaming music (e.g., increase/decrease volume, change song, etc.). The system 100 may identify the location of the listener and may generate the second audio output in proximity to the listener (e.g., Zone A) to provide feedback to the listener indicating that the command was received and performed by the system 100, without generating the second audio output in other sound zones.

While the above examples illustrate the system 100 dividing the shared acoustic environment into multiple sound zones in advance, the disclosure is not limited thereto and the system 100 may divide the shared acoustic environment into multiple sound zones based on input(s) from the listener(s), location(s) of the listener(s), or the like. For example, the system 100 may include all of the couch in front of the first device 110*a* (e.g., television) as part of Zone A at a first time, but may select only a portion of the couch as Zone A at a second time.

Figure 8:
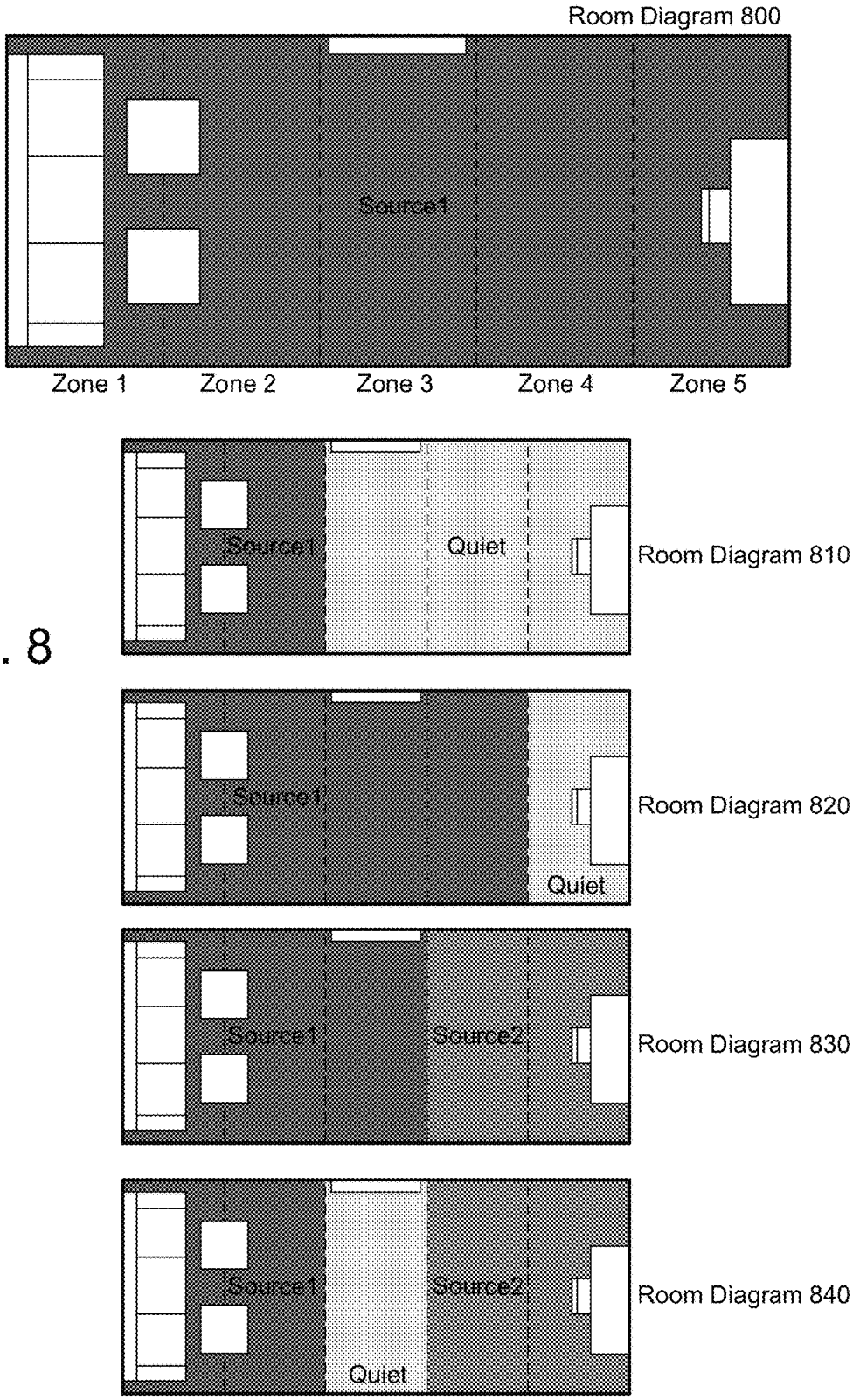
FIG. 8 illustrates examples of dynamically updating sound zones according to examples of the present disclosure.

FIG. 8 illustrates examples of dynamically updating sound zones according to examples of the present disclosure. As illustrated in FIG. 8, a shared acoustic environment (e.g., room) may be divided into discrete sound zones (e.g., Zones 1-5) and the system 100 may dynamically update ASZs and QSZs by selecting individual sound zones. For example, the system 100 may divide the room shown in FIG. 7 into five sound zones, with Zone 1 including a couch, Zone 3 including a television and Zone 5 including a desk.

Room diagram 800 illustrates the system 100 generating audio output from a first audio source (e.g., Source1) in all of the sound zones (e.g., Zones 1-5) at a first time. At a second time, however, the system 100 may select a first portion of the sound zones (e.g., Zones 1-2) to be included in a ASZ and a second portion of the sound zones (e.g., Zones 3-5) to be included in a QSZ, as illustrated in room diagram 810. Thus, the system 100 may generate audio output from the first audio source (e.g., Source1) primarily in the first portion (e.g., Zones 1-2), enabling a first user in the first portion to hear the audio output at a high volume level while a second user in the second portion hears the audio output at a low volume level.

At a third time, the system 100 may decide to dynamically update the ASZ to include Zones 3-4, as illustrated in room diagram 820. For example, a user may instruct the system 100 to increase the ASZ or the system 100 may determine to increase the ASZ based on other inputs. For example, a third user may enter the room and appear to be watching the television in Zone 4, so the system 100 may increase the ASZ to include Zone 4 to enable the third user to hear the audio corresponding to the television. Additionally or alternatively, the second user may leave the room and the system 100 may decrease the QSZ.

At a fourth time, the system 100 may determine to generate second audio from a second audio source (e.g., Source2) in Zones 4-5. For example, the second user may instruct the system 100, the system 100 may determine that the second user began viewing content with corresponding audio, and/or the like. Thus, the system 100 may generate the first audio in Zones 1-3 from the first audio source (e.g., Source1), using Zones 1-3 as an ASZ and Zones 4-5 as a QSZ, while generating the second audio in Zones 4-5 from the second audio source (e.g., Source2), using Zones 4-5 as a ASZ and Zones 1-3 as a QSZ.

At a fourth time, the system 100 may determine to include Zone 3 in the QSZ for both the first audio source and the second audio source. For example, the system 100 may determine that no user is present in Zone 3, may determine to decrease audio interference between the two ASZs, and/or the like. Thus, the system 100 may generate the first audio in Zones 1-2 from the first audio source (e.g., Source1), using Zones 1-2 as an ASZ and Zones 3-5 as a QSZ, while generating the second audio in Zones 4-5 from the second audio source (e.g., Source2), using Zones 4-5 as a ASZ and Zones 1-3 as a QSZ.

While FIG. 8 illustrates multiple examples of dynamically updating sound zones, the disclosure is not limited thereto and the system 100 may update the sound zones based on other inputs and/or determination steps without departing from the disclosure. Additionally or alternatively, while FIG. 8 illustrates the room being divided into five sound zones, the disclosure is not limited thereto and the room may be divided into any number of sound zones without departing from the disclosure.

As discussed above with regard to FIG. 7, the system 100 may update the ASZ(s), QSZ(s) and the audio source(s) based on a number of inputs, including instructions received from a user, tracking the user(s) within the shared acoustic environment, and/or the like. Thus, the system 100 may dynamically add a sound zone to an ASZ and/or QSZ and/or remove the sound zone from an ASZ and/or QSZ. Therefore, the sound zones are reconfigurable and the system 100 may enable the user to select audio source(s), an ASZ and/or QSZ for each audio source, and/or the like while the system 100 generates audio.

In some examples, the system 100 may divide the shared acoustic environment into multiple sound zones in advance. For example, the system 100 may determine locations associated with each sound zone and solve for filter coefficients corresponding to a plurality of different configurations in advance. Thus, when the system 100 determines to generate the ASZ (e.g., Zones 1-3) and the QSZ (e.g., Zones 4-5) for a specific configuration, instead of calculating the filter coefficients the system 100 may retrieve the filter coefficients that were previously calculated for this configuration. As the user(s) move within the shared acoustic environment and/or select different sound zones to be included in the ASZ(s) and/or QSZ(s), the system 100 may identify the current configuration and retrieve filter coefficients corresponding to the current configuration.

Figure 9:
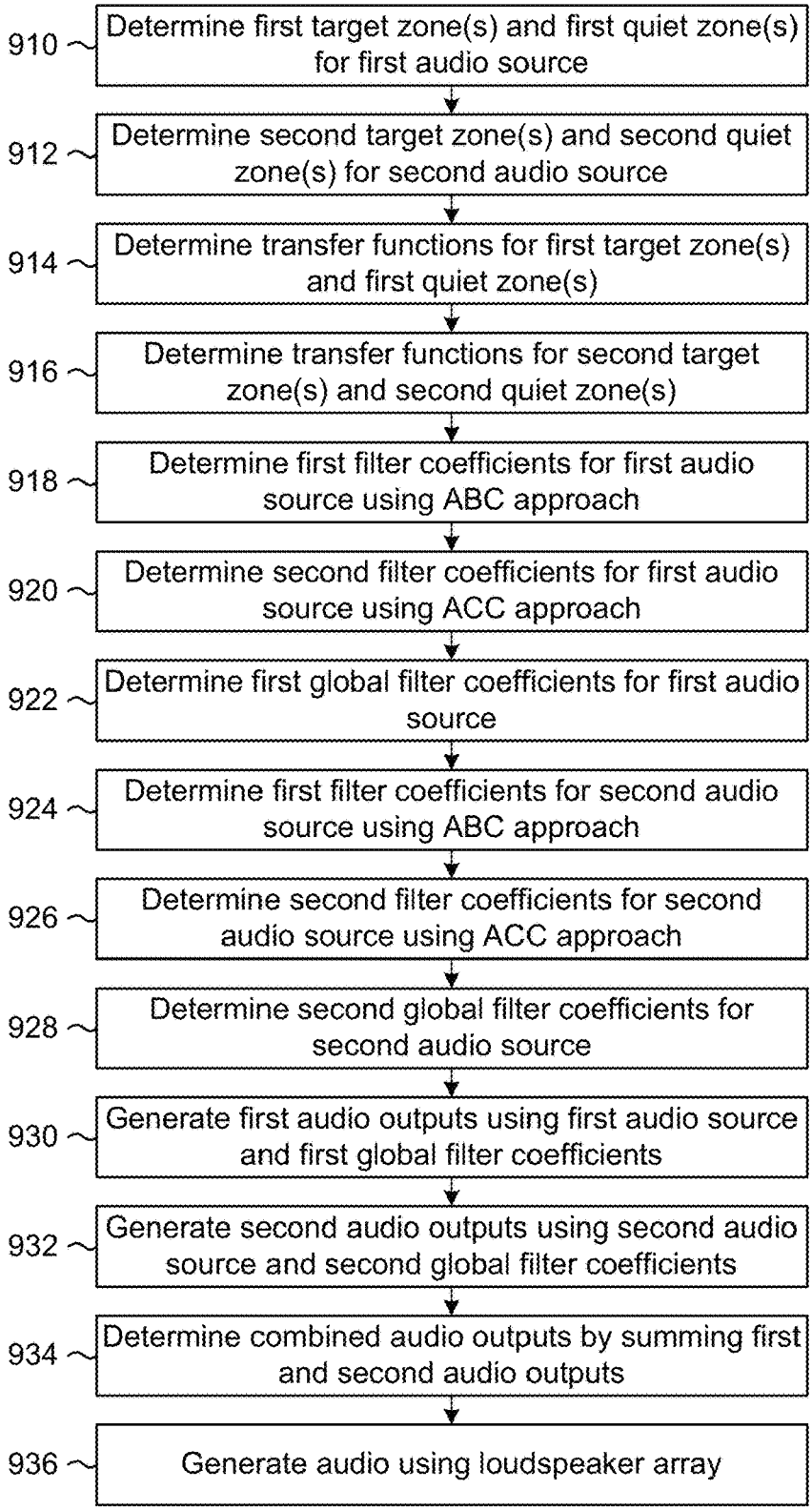
FIG. 9 is a flowchart conceptually illustrating example methods for generating audio output using multiple audio sources according to examples of the present disclosure.

FIG. 9 is a flowchart conceptually illustrating example methods for generating audio output using multiple audio sources according to examples of the present disclosure. As illustrated in FIG. 9, the system 100 may determine (910) first target zone(s) and first quiet zone(s) for a first audio source and may determine (912) second target zone(s) and second quiet zone(s) for a second audio source. For example, the system 100 may select Zone A as the first target zone and Zone B for the first quiet zone for the first audio source and may select Zone B as the second target zone and Zone A for the first quiet zone for the second audio source. As discussed above, the disclosure is not limited thereto and the system 100 may select any number of target zone(s) and/or quiet zone(s) for the first audio source and/or the second audio source without departing from the disclosure.

The system 100 may determine (914) transfer functions associated with the first target zone(s) and the first quiet zone(s) and may determine (916) transfer functions associated with the second target zone(s) and the second quiet zone(s). For example, the system 100 may determine a first transfer function matrix $H_A(\omega)$ for Zone A (e.g., first target zone) and a second transfer function matrix $H_B(\omega)$ for Zone B (e.g., first quiet zone), as described above with regard to Equations (3) and (4). Similarly, the system 100 may determine a third transfer function matrix $H_B(\omega)$ for Zone B (e.g., second target zone) and a fourth transfer function matrix $H_A(\omega)$ for Zone A (e.g., second quiet zone). In this example, the system 100 may simply generate the first transfer function matrix $H_A(\omega)$ for Zone A and the second transfer function matrix $H_B(\omega)$ for Zone B and may use both transfer function matrixes for the first audio source and the second audio source. However, the disclosure is not limited thereto and in some examples, the first target zone(s) and the second quiet zone(s) may be different and/or the second target zone(s) and the first quiet zone(s) may be different, requiring the system 100 to calculate unique transfer function matrixes for the first audio source and the second audio source.

The system 100 may determine (918) first filter coefficients $f(\omega)$ for the first audio source using the ABC approach, which maximizes a first sound pressure value (e.g., volume level) in the first target zone (e.g., Zone A) without regard to a second sound pressure value in the first quiet zone (e.g., Zone B). For example, the system 100 may determine the first filter coefficients $f(\omega)$ for the first audio source using Equation (7) discussed above. Similarly, the system 100 may determine (920) second filter coefficients $q(\omega)$ for the first audio source using the ACC approach, which maximizes a ratio between the first sound pressure value and the second sound pressure value. For example, the system 100 may determine the second filter coefficients $q(\omega)$ for the first audio source using Equation (16) discussed above. The system 100 may determine (922) first global filter coefficients $G_1(\omega)$ using a combination of the first filter coefficients $f(\omega)$ and the second filter coefficients $q(\omega)$ for the first audio source. For example, the system 100 may use a weighted sum of the first filter coefficients $f(\omega)$ and the second filter coefficients $q(\omega)$, as discussed above with regard to Equation (21).

The system 100 may determine (924) first filter coefficients $f(\omega)$ for the second audio source using the ABC approach, which maximizes a third sound pressure value (e.g., volume level) in the second target zone (e.g., Zone B) without regard to a fourth sound pressure value in the second quiet zone (e.g., Zone A). For example, the system 100 may determine the first filter coefficients f(ω) for the second audio source using Equation (7) discussed above. Similarly, the system 100 may determine (926) second filter coefficients q(ω) for the second audio source using the ACC approach, which maximizes a ratio between the third sound pressure value and the fourth sound pressure value. For example, the system 100 may determine the second filter coefficients q(ω) for the second audio source using Equation (16) discussed above. The system 100 may determine (928) second global filter coefficients $G_2(\omega)$ using a combination of the first filter coefficients f(ω) and the second filter coefficients q(ω) for the second audio source. For example, the system 100 may use a weighted sum of the first filter coefficients f(ω) and the second filter coefficients q(ω), as discussed above with regard to Equation (21).

The system 100 may generate (930) first audio outputs using the first audio source and the first global filter coefficients. For example, the system 100 may convert the first global filter coefficients $G_1(\omega)$ into a vector of FIR filters g(k) (e.g., $g_1(k)$, $g_2(k)$ . . . $g_L(k)$) and may apply the filters g(k) to first audio data associated with the first audio source to generate the first audio outputs. Similarly, the system 100 may generate (932) second audio outputs using the second audio source and the second global filter coefficients. For example, the system 100 may convert the second global filter coefficients $G_2(\omega)$ into a vector of FIR filters u(k) (e.g., $u_1(k)$, $u_2(k)$ . . . $u_L(k)$) and may apply the filters u(k) to second audio data associated with the second audio source to generate the second audio outputs.

The system 100 may determine (934) combined audio outputs by summing the first audio outputs and the second audio outputs for each individual loudspeaker in the loudspeaker array 112, as described above with regard to FIG. 6. The system 100 may then generate (936) audio using the loudspeaker array and the combined audio outputs. Thus, a listener may hear the first audio output at a high volume level in Zone A and may hear the second audio output at a high volume in Zone B, despite the system 100 generating the first audio output and the second audio output using a single loudspeaker array 112.

Figure 10:
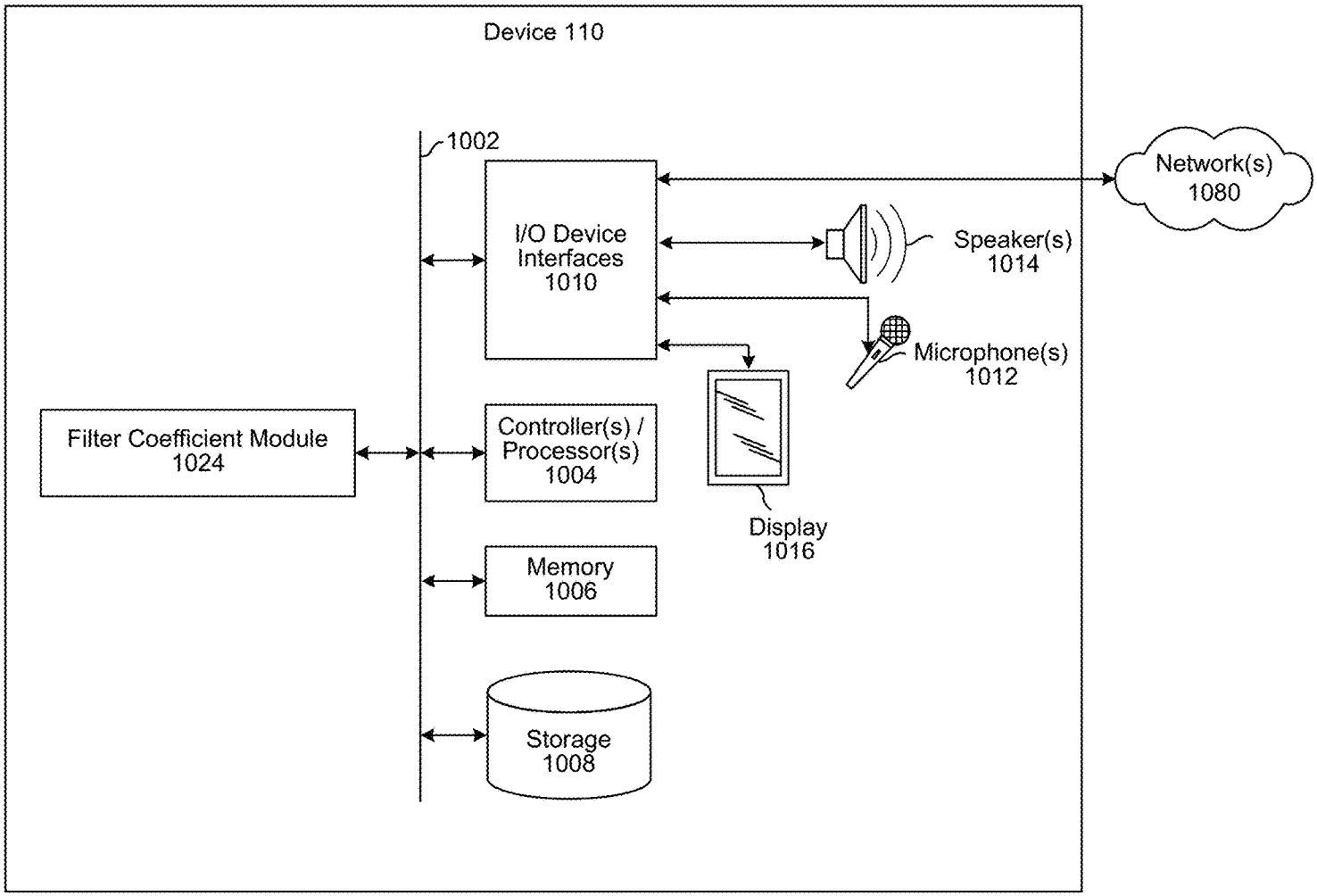
FIG. 10 is a block diagram conceptually illustrating example components of a system for sound zone reproduction according to embodiments of the present disclosure.

FIG. 10 is a block diagram conceptually illustrating example components of a system for sound zone reproduction according to embodiments of the present disclosure. In operation, the system 100 may include computer-readable and computer-executable instructions that reside on the device 110, as will be discussed further below. The device 110 may be an electronic device capable of generating audio data, determining filter coefficients for a loudspeaker array 112 and/or outputting the audio data using the loudspeaker array 112. Examples of electronic devices may include computers (e.g., a desktop, a laptop, a server or the like), portable devices (e.g., a camera (such as a 360° video camera, a security camera, a mounted camera, a portable camera or the like), smart phone, tablet or the like), media devices (e.g., televisions, video game consoles, stereo systems, entertainment systems or the like) or the like. The device 110 may also be a component of any of the above-mentioned devices or systems.

As illustrated in FIG. 10, the device 110 may include an address/data bus 1002 for conveying data among components of the device 110. Each component within the device 110 may also be directly connected to other components in addition to (or instead of) being connected to other components across the bus 1002.

The device 110 may include one or more controllers/processors 1004, that may each include a central processing unit (CPU) for processing data and computer-readable instructions, and a memory 1006 for storing data and instructions. The memory 1006 may include volatile random access memory (RAM), non-volatile read only memory (ROM), non-volatile magnetoresistive (MRAM) and/or other types of memory. The device 110 may also include a data storage component 1008, for storing data and controller/processor-executable instructions (e.g., instructions to perform the algorithm illustrated in FIGS. 1, and/or 9). The data storage component 1008 may include one or more non-volatile storage types such as magnetic storage, optical storage, solid-state storage, etc. The device 110 may also be connected to removable or external non-volatile memory and/or storage (such as a removable memory card, memory key drive, networked storage, etc.) through the input/output device interfaces 1010.

The device 110 includes input/output device interfaces 1010. A variety of components may be connected through the input/output device interfaces 1010, such as a loudspeaker array 112, microphone(s) 1012, speakers 1014, and/or a display 1016 connected to the device 110. However, the disclosure is not limited thereto and the device 110 may not include integrated loudspeaker array 112, microphone(s) 1012, speakers 1014, and/or display 1016. Thus, the loudspeaker array 112, the microphone(s) 1012, the speakers 1014, the display 1016 and/or other components may be integrated into the device 110 or may be separate from the device 110 without departing from the disclosure. For example, the device 110 may include the loudspeaker array 112 and may generate audio output using the loudspeaker array 110, or the loudspeaker array 112 may be separate from the device 110 and the device 110 may send filter coefficients and/or audio data to the loudspeaker array 112 to generate the audio output. In some examples, the device 110 may include an inertial measurement unit (IMU), gyroscope, accelerometers or other component configured to provide motion data or the like associated with the device 110. If an array of microphones 1012 is included, approximate distance to a sound's point of origin may be performed acoustic localization based on time and amplitude differences between sounds captured by different microphones of the array.

The input/output device interfaces 1010 may be configured to operate with network(s) 1090, for example wired networks such as a wired local area network (LAN), and/or wireless networks such as a wireless local area network (WLAN) (such as WiFi), Bluetooth, ZigBee, a Long Term Evolution (LTE) network, WiMAX network, 3G network, etc. The network(s) 1090 may include a local or private network or may include a wide network such as the internet. Devices may be connected to the network(s) 1090 through either wired or wireless connections.

The input/output device interfaces 1010 may also include an interface for an external peripheral device connection such as universal serial bus (USB), FireWire, Thunderbolt, Ethernet port or other connection protocol that may connect to network(s) 1090. The input/output device interfaces 1010 may also include a connection to an antenna (not shown) to connect one or more network(s) 1090 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc.

The device 110 further includes a filter coefficient module 1024, which may comprise processor-executable instructions stored in storage 1008 to be executed by controller(s)/processor(s) 1004 (e.g., software, firmware, hardware, or some combination thereof). For example, components of the filter coefficient module 1024 may be part of a software application running in the foreground and/or background on the device 110. The filter coefficient module 1024 may control the device 110 as discussed above, for example with regard to FIGS. 1, and/or 9. Some or all of the controllers/modules of the filter coefficient module 1024 may be executable instructions that may be embedded in hardware or firmware in addition to, or instead of, software. In one embodiment, the device 110 may operate using an Android operating system (such as Android 4.3 Jelly Bean, Android 4.4 KitKat or the like), an Amazon operating system (such as FireOS or the like), or any other suitable operating system.

Executable computer instructions for operating the device 110 and its various components may be executed by the controller(s)/processor(s) 1004, using the memory 1006 as temporary "working" storage at runtime. The executable instructions may be stored in a non-transitory manner in non-volatile memory 1006, storage 1008, or an external device. Alternatively, some or all of the executable instructions may be embedded in hardware or firmware in addition to or instead of software.

The components of the device 110, as illustrated in FIG. 10, are exemplary, and may be located a stand-alone device or may be included, in whole or in part, as a component of a larger device or system.

The concepts disclosed herein may be applied within a number of different devices and computer systems, including, for example, general-purpose computing systems, server-client computing systems, mainframe computing systems, telephone computing systems, laptop computers, cellular phones, personal digital assistants (PDAs), tablet computers, video capturing devices, video game consoles, speech processing systems, distributed computing environments, etc. Thus the modules, components and/or processes described above may be combined or rearranged without departing from the scope of the present disclosure. The functionality of any module described above may be allocated among multiple modules, or combined with a different module. As discussed above, any or all of the modules may be embodied in one or more general-purpose microprocessors, or in one or more special-purpose digital signal processors or other dedicated microprocessing hardware. One or more modules may also be embodied in software implemented by a processing unit. Further, one or more of the modules may be omitted from the processes entirely.

The above embodiments of the present disclosure are meant to be illustrative. They were chosen to explain the principles and application of the disclosure and are not intended to be exhaustive or to limit the disclosure. Many modifications and variations of the disclosed embodiments may be apparent to those of skill in the art. Persons having ordinary skill in the field of computers and/or digital imaging should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Embodiments of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media.

Embodiments of the present disclosure may be performed in different forms of software, firmware and/or hardware. Further, the teachings of the disclosure may be performed by an application specific integrated circuit (ASIC), field programmable gate array (FPGA), or other component, for example.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is to be understood with the context as used in general to convey that an item, term, etc. may be either X, Y, or Z, or a combination thereof. Thus, such conjunctive language is not generally intended to imply that certain embodiments require at least one of X, at least one of Y and at least one of Z to each is present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method for focusing audio output in a target region using a loudspeaker array, the method comprising, by a device coupled to the loudspeaker array:

receiving audio data from a first audio source;

determining the target region in which to focus the audio output, the target region being proximate to at least a portion of the loudspeaker array;

determining a first transfer function modeling an impulse response at a first location within the target region;

determining a second region adjacent to and separate from the target region in which to not focus the audio output, the second region being proximate to at least a portion of the loudspeaker array;

determining a second transfer function modeling an impulse response at a second location within the second region;

determining a first filter coefficient for the loudspeaker array, the first filter coefficient configured to maximize a first volume level of the audio output in the target region;

determining a second filter coefficient for the loudspeaker array, the second filter coefficient configured to maximize a ratio of the first volume level, squared, and a second volume level, squared, of the audio output in the second region, squared;

generating a combined filter coefficient by summing the first filter coefficient and the second filter coefficient, the combined filter coefficient corresponding to a first loudspeaker in the loudspeaker array; and generating, by the loudspeaker array and using the audio data, the audio output using at least the combined filter coefficient corresponding to a first loudspeaker in the loudspeaker array, the audio output directed at the target region and configured to create constructive interference in the target region and to create destructive interference in the second region.

2. The computer-implemented method of claim 1, further comprising:

receiving second audio data from a second audio source;

determining a third filter coefficient for the loudspeaker array, the third filter coefficient configured to maximize a third volume level of second audio output in the second region;

determining a fourth filter coefficient for the loudspeaker array, the fourth filter coefficient configured to maximize a ratio of the third volume level, squared, and a fourth volume level of the second audio output in the target region, squared;

generating a second combined filter coefficient based on the third filter coefficient and the fourth filter coefficient;

generating first output audio data using the combined filter coefficient and the audio data;

generating second output audio data using the second combined filter coefficient and the second audio data; and generating, by the loudspeaker array, the audio output using the first output audio data and second audio output using the second output audio data, wherein the audio output is directed to the target region and the second audio output is directed to the second region.

3. The computer-implemented method of claim 1, further comprising:

determining a third location that is associated with the first audio source, the third location being proximate to at least a portion of the loudspeaker array;

determining a fourth location that is not associated with the first audio source, the fourth location being proximate to at least a portion of the loudspeaker array;

determining the target region such that the target region includes the third location but not the fourth location; and determining the second region such that the second region includes the fourth location but not the third location.

4. The computer-implemented method of claim 1, further comprising:

identifying a first person associated with the audio output, the first person being proximate to at least a portion of the loudspeaker array;

determining, at a first time, a third location associated with the first person;

determining the target region based on the third location, the target region including the third location at the first time;

determining the second region, the second region including a fourth location outside of the target region at the first time;

detecting, at a second time after the first time, that the first person is at the fourth location;

determining the target region based on the fourth location, the target region including the fourth location at the second time; and determining the second region, the second region including the third location at the second time.

5. A computer-implemented method, comprising:

determining a first transfer function modeling an impulse response at a first location within a first region, the first region proximate to a loudspeaker array;

determining first filter coefficients for the loudspeaker array, the first filter coefficients configured to generate a first sound pressure value that is above a first threshold value, the first sound pressure value being associated with the first region;

determining second filter coefficients for the loudspeaker array, the second filter coefficients configured to determine that a ratio of the first sound pressure value, squared, and a second sound pressure value, squared, is greater than a second threshold value, the second sound pressure value associated with a second region but separate from the first region;

generating third filter coefficients based on the first filter coefficients and the second filter coefficients;

generating output audio data based on the third filter coefficients; and causing first audio corresponding to the output audio data to be output by at least one speaker of the loudspeaker array, the first audio directed at the first region and corresponding to a first audio source.

6. The computer-implemented method of claim 5, further comprising:

determining a second transfer function modeling an impulse response at a second location within the second region.

7. The computer-implemented method of claim 5, further comprising:

determining fourth filter coefficients for the loudspeaker array, the fourth filter coefficients configured to generate a third sound pressure value that is above a third threshold value, the third sound pressure value being associated with the second region;

determining fifth filter coefficients for the loudspeaker array, the fifth filter coefficients configured to determine a second ratio that is above a fourth threshold value, the second ratio being between the third sound pressure value, squared, and a fourth sound pressure value, squared, the fourth sound pressure value being associated with the first region;

generating sixth filter coefficients based on the fourth filter coefficients and the fifth filter coefficients;

generating second output audio data based on the sixth filter coefficients;

generating, based on the output audio data and the second output audio data, combined output audio data; and sending the combined output audio data to the at least one speaker of the loudspeaker array.

8. The computer-implemented method of claim 5, further comprising:

causing the loudspeaker array to output second audio directed at the second region, the second audio corresponding to a second audio source different from the first audio source.

9. The computer-implemented method of claim 5, further comprising:

determining fourth filter coefficients for the loudspeaker array, the fourth filter coefficients configured to generate a third sound pressure value that is above a third threshold value, the third sound pressure value being associated with a first portion of the second region;

determining fifth filter coefficients for the loudspeaker array, the fifth filter coefficients configured to determine a second ratio that is above a fourth threshold value, the second ration being between the third sound pressure value, squared, and a fourth sound pressure value, squared, the fourth sound pressure value associated with the first region and a second portion of the second region;

generating sixth filter coefficients based on the fourth filter coefficients and the fifth filter coefficients;

generating second output audio data based on the sixth filter coefficients;

generating, based on the output audio data and the second output audio data, combined output audio data; and sending the combined output audio data to the at least one speaker of the loudspeaker array.

10. The computer-implemented method of claim 5, further comprising:

receiving first audio data from the first audio source;

determining the first location associated with the first audio source, the first location being proximate to at least a portion of the loudspeaker array;

determining a second location that is not associated with the first audio source, the second location being proximate to at least a portion of the loudspeaker array;

determining the first region based on the first location and the second location, the first region including the first location but not the second location; and determining the second region based on the first location and the second location, the second region including the second location but not the first location.

11. The computer-implemented method of claim 5, further comprising:

identifying a first person associated with the output audio data, the first person being proximate to at least a portion of the loudspeaker array;

determining, at a first time, the first location associated with the first person;

determining the first region based on the first location, the first region including the first location at the first time; and determining the second region, the second region including a second location outside of the first region at the first time.

12. The computer-implemented method of claim 11, further comprising:

detecting, at a second time after the first time that the first person is at the second location;

determining the first region based on the second location, the first region including the second location at the second time; and determining the second region, the second region including the first location at the second time.

13. A device, comprising:

at least one processor;

memory including instructions operable to be executed by the at least one processor to perform a set of actions to cause the device to:

determine a first transfer function modeling an impulse response at a first location within a first region, the first region proximate to a loudspeaker array;

determine first filter coefficients for the loudspeaker array, the first filter coefficients configured to generate a first sound pressure value that is above a first threshold value, the first sound pressure value being associated with the first region;

determine second filter coefficients for the loudspeaker array, the second filter coefficients configured to determine that a ratio of the first sound pressure value, squared, and a second sound pressure value, squared, is greater than a second threshold value, the second sound pressure value associated with a second region but separate from the first region;

generate third filter coefficients based on the first filter coefficients and the second filter coefficients;

generate output audio data based on the third filter coefficients; and cause first audio corresponding to the output audio data to be output by at least one speaker of the loudspeaker array, the first audio directed at the first region and corresponding to a first audio source.

14. The system of claim 13, wherein the memory further comprises instructions that, when executed by the at least one processor, further cause the device to:

determine a second transfer function modeling an impulse response at a second location within the second region.

15. The system of claim 13, wherein the memory further comprises instructions that, when executed by the at least one processor, further cause the device to:

determine fourth filter coefficients for the loudspeaker array, the fourth filter coefficients configured to generate a third sound pressure value that is above a third threshold value, the third sound pressure value being associated with the second region;

determine fifth filter coefficients for the loudspeaker array, the fifth filter coefficients configured to determine a second ratio that is above a fourth threshold value, the second ratio being between the third sound pressure value, squared, and a fourth sound pressure value, squared, the fourth sound pressure value associated with the first region;

generate sixth filter coefficients based on the fourth filter coefficients and the fifth filter coefficients;

generate second output audio data based on the sixth filter coefficients;

generate, based on the output audio data and the second output audio data, combined output audio data; and sending the combined output audio data to the at least one speaker of the loudspeaker array.

16. The system of claim 13, wherein the memory further comprises instructions that, when executed by the at least one processor, further cause the device to:

cause the loudspeaker array to output second audio directed at the second region, the second audio corresponding to a second audio source different from the first audio source.

17. The system of claim 13, wherein the memory further comprises instructions that, when executed by the at least one processor, further cause the device to:

determine fourth filter coefficients for the loudspeaker array, the fourth filter coefficients configured to generate a third sound pressure value that is above a third threshold value, the third sound pressure value being associated with a first portion of the second region;

determine fifth filter coefficients for the loudspeaker array, the fifth filter coefficients configured to determine a second ratio that is above a fourth threshold value, the second ratio being between the third sound pressure value, squared, and a fourth sound pressure value, squared, the fourth sound pressure value associated with the first region and a second portion of the second region;

generate second output audio data based on the sixth filter coefficients;

generate, based on the output audio data and the second output audio data, combined output audio data; and sending the combined output audio data to the at least one speaker of the loudspeaker array.

18. The system of claim 13, wherein the memory further comprises instructions that, when executed by the at least one processor, further cause the device to:

receive first audio data from the first audio source;

determine the first location that is associated with the first audio source, the first location being proximate to at least a portion of the loudspeaker array;

determine a second location that is not associated with the first audio source, the second location being proximate to at least a portion of the loudspeaker array;

determine the first region based on the first location and the second location, the first region including the first location but not the second location; and determine the second region based on the first location and the second location, the second region including the second location but not the first location.

19. The system of claim 13, wherein the memory further comprises instructions that, when executed by the at least one processor, further cause the device to:

identify a first person associated with the output audio data, the first person being proximate to at least a portion of the loudspeaker array;

determine, at a first time, a first location associated with the first person;

determine the first region based on the first location, the first region including the first location at the first time; and determine the second region, the second region including a second location outside of the first region at the first time.

20. The system of claim 19, wherein the memory further comprises instructions that, when executed by the at least one processor, further cause the device to:

detect, at a second time after the first time, that the first person is at the second location;

determine the first region based on the second location, the first region including the second location at the second time; and determine the second region, the second region including the first location at the second time.

* * * * *